US011841014B1

(12) United States Patent
Jo et al.

(10) Patent No.: US 11,841,014 B1
(45) Date of Patent: Dec. 12, 2023

(54) SCROLL COMPRESSOR

(71) Applicant: LG ELECTRONICS INC., Seoul (KR)

(72) Inventors: Changeol Jo, Seoul (KR); Jeonghun Kim, Seoul (KR); Nara Han, Seoul (KR); Jihoon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/109,559

(22) Filed: Feb. 14, 2023

(30) Foreign Application Priority Data

Jun. 9, 2022 (KR) ..... 10-2022-0070270

(51) Int. Cl.
*F04C 28/26* (2006.01)
*F04C 29/12* (2006.01)
*F04C 18/02* (2006.01)

(52) U.S. Cl.
CPC ..... *F04C 18/0261* (2013.01); *F04C 18/0215* (2013.01); *F04C 29/124* (2013.01)

(58) Field of Classification Search
CPC .... F04C 18/026; F04C 18/0215; F04C 29/12; F04C 29/124; F04C 29/126; F04C 28/26
See application file for complete search history.

(56) References Cited

U.S. PATENT DOCUMENTS 5,707,210 A * 1/1998 Ramsey ..... F04C 28/28 417/310
2015/0345493 A1 12/2015 Lochner et al.
2018/0038370 A1 2/2018 Doepker et al.

FOREIGN PATENT DOCUMENTS

KR 10-2014-0114212 9/2014

* cited by examiner

*Primary Examiner* — Deming Wan
(74) *Attorney, Agent, or Firm* — KED & ASSOCIATES, LLP

(57) ABSTRACT

A scroll compressor is provided. In the scroll compressor, a valve accommodating groove that accommodates a discharge port and bypass holes is recessed by a predetermined depth into a rear surface of a non-orbiting scroll, and a valve guide is disposed between the rear surface of the non-orbiting scroll and a rear surface of the back pressure chamber assembly facing the rear surface of the non-orbiting scroll. Bypass valve guide holes into which bypass valves that open and close the bypass holes are slidably inserted are formed in the valve guide. Accordingly, the bypass valves that suppress or prevent overcompression in compression chambers are not fastened to a non-orbiting end plate, which may allow the non-orbiting end plate to be reduced in thickness. As the non-orbiting end plate is reduced in thickness, lengths of the bypass holes may be reduced, thereby decreasing dead volumes in the bypass holes.

25 Claims, 19 Drawing Sheets

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2022-0070270, filed in Korea on Jun. 9, 2022, the contents of which are incorporated by reference herein in their entirety.

BACKGROUND

1. Field

A scroll compressor is disclosed herein.

2. Background

A scroll compressor is configured such that an orbiting scroll and a non-orbiting scroll are engaged with each other and a pair of compression chambers is formed between the orbiting scroll and the non-orbiting scroll while the orbiting scroll performs an orbiting motion with respect to the non-orbiting scroll. Each compression chamber includes a suction pressure chamber formed at an outer side, an intermediate pressure chamber continuously formed toward a central portion from the suction pressure chamber while gradually decreasing in volume, and a discharge pressure chamber connected to a center of the intermediate pressure chamber. Typically, the suction pressure chamber communicates with a refrigerant suction pipe through a side surface of the non-orbiting scroll, the intermediate pressure chamber is sealed and connected in multiple stages, and the discharge pressure chamber communicates with a refrigerant discharge pipe through a center of an end plate of the non-orbiting scroll.

The scroll compressor is configured so that the compression chamber continuously moves, which may cause overcompression during operation. Accordingly, in the related art scroll compressor, a bypass hole is formed around a discharge port, that is, at an upstream side of the discharge port to discharge overcompressed refrigerant in advance. A bypass valve is disposed in the bypass hole to open and close the bypass hole according to pressure in the compression chamber. A plate valve or a reed valve is mainly applied as the bypass valve.

U.S. Patent Publication No. 2018/0038370 (hereinafter "Patent Document 1"), which is hereby incorporated by reference, discloses a scroll compressor to which a bypass valve configured as a plate valve is applied. Patent Document 1 discloses that a single bypass valve in an annular shape opens and closes a plurality of bypass holes, but this increases the number of components as the bypass valve is supported by an elastic member. In addition, as the bypass valve operates in a separated state, it is difficult to modularize the bypass valve, which may increase the number of assembly processes of the compressor. As a length of the bypass hole increases, not only overcompression due to discharge delay occurs, but also a dead volume increases, which may decrease indicated efficiency.

Korean Patent Publication No. 10-2014-0114212 (hereinafter "Patent Document 2"), which is hereby incorporated by reference, and U.S. Patent Publication No. 2015/0345493 (hereinafter "Patent Document 3"), which is hereby incorporated by reference, each discloses a scroll compressor to which a bypass valve configured as a reed valve is applied.

In Patent Document 2 and Patent Document 3, the bypass valve is fixed to a non-orbiting scroll using a rivet or pin. For this, an end plate of the non-orbiting scroll should be as thick as a rivet depth or a pin depth, which causes an increase in length of the bypass hole. As a result, as in Patent Document 1, refrigerant discharge through the bypass hole is delayed and thereby the refrigerant is overcompressed. In addition, a dead volume increases due to the increased length of the bypass hole, causing indicated efficiency to be degraded.

BRIEF DESCRIPTION OF THE DRAWINGS

Embodiments will be described in detail with reference to the following drawings in which like reference numerals refer to like elements, and wherein.

DETAILED DESCRIPTION

Figure 1:
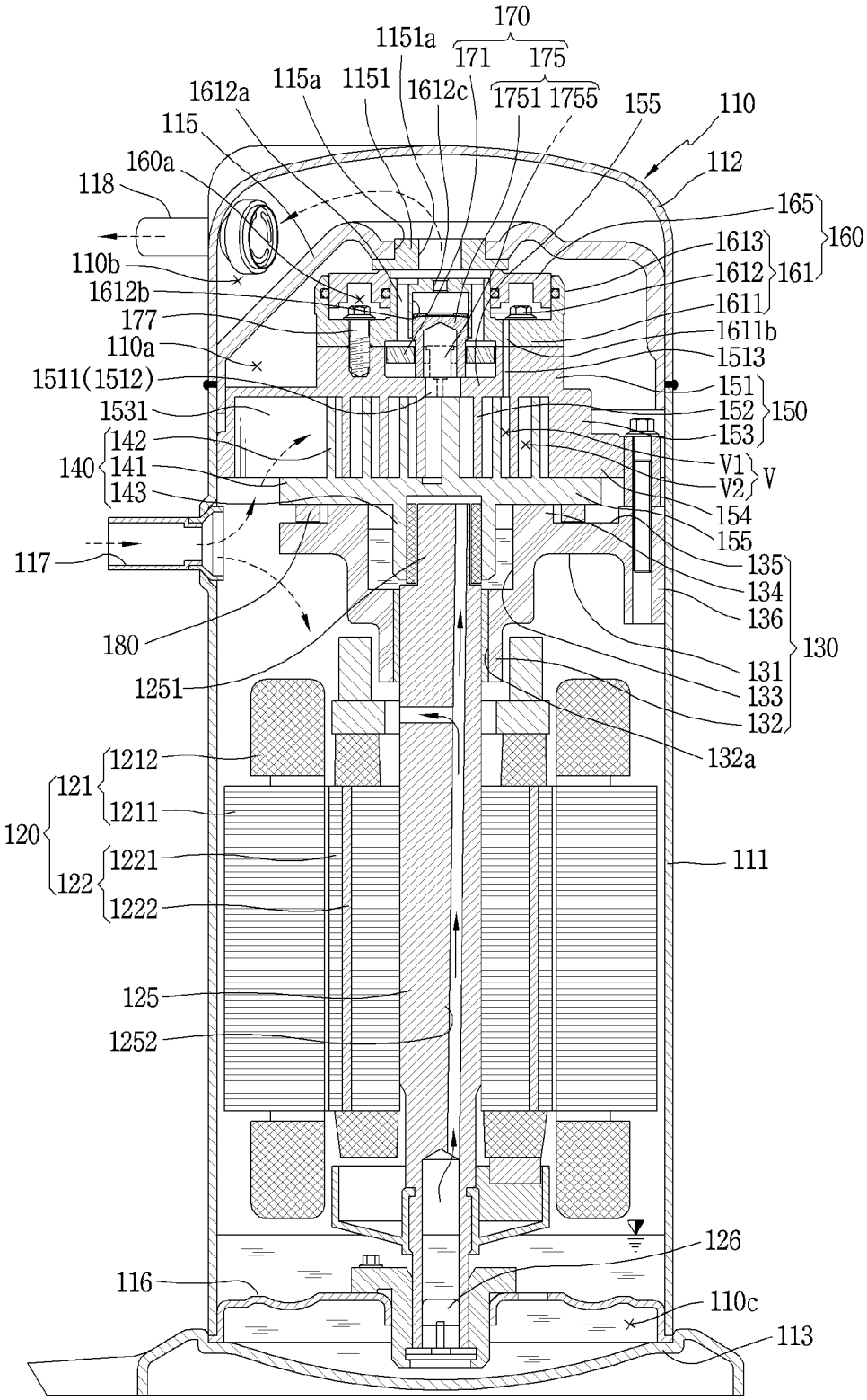
FIG. 1 is a longitudinal cross-sectional view illustrating an inner structure of a capacity-variable scroll compressor in accordance with an embodiment.

Description will now be given of a scroll compressor according to embodiments disclosed herein, with reference to the accompanying drawings.

Typically, a scroll compressor may be classified as an open type or a hermetic type depending on whether a drive (motor) and a compression part or portion are all installed in an inner space of a casing. The former is a compressor in which the motor configuring the drive is provided separately from the compression portion, and the latter hermetic type is a compressor in which both the motor and the compression are disposed inside of the casing. Hereinafter, a hermetic type scroll compressor will be described as an example, but it is not necessarily limited to the hermetic scroll compressor. In other words, embodiments may be equally applied even to the open type scroll compressor in which the motor and the compression portion are disposed separately from each other.

A scroll compressor is also classified as a low-pressure type compressor or a high-pressure type compressor depending on what type of pressure is defined in an inner space of a casing, specifically, a space accommodating the motor in a hermetic scroll compressor. In the former, the space defines a low-pressure part or portion and a refrigerant suction pipe communicates with the space. On the other hand, in the latter, the space defines a high-pressure part or portion and the refrigerant suction pipe is directly connected to the compression portion through the casing. Hereinafter, a low-pressure type scroll compressor according to an embodiment will be described as an example. However, embodiments are not limited to the low-pressure type scroll compressor.

In addition, scroll compressors may be classified into a vertical scroll compressor in which a rotary shaft is disposed perpendicular to the ground and a horizontal (lateral) scroll compressor in which the rotary shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, embodiments may also be equally applied to the horizontal scroll compressor. Hereinafter, it will be understood that an axial direction is an axial direction of the rotary shaft, a radial direction is a radial direction of the rotary shaft, the axial direction is an upward and downward direction, the radial direction is a left and right or lateral direction, and an inner circumferential surface is an upper surface, respectively.

In addition, scroll compressors may be mainly divided into a tip seal type and a back pressure type depending on a method of sealing between compression chambers. The back pressure type may be divided into an orbiting back pressure type of pressing an orbiting scroll toward a non-orbiting scroll, and a non-orbiting back pressure type of pressing the non-orbiting scroll toward the orbiting scroll. Hereinafter, a scroll compressor to which a non-orbiting back pressure type is applied will be described as an example. However, embodiments may also be applied to the tip seal type as well as the orbiting back pressure type.

Figure 2:
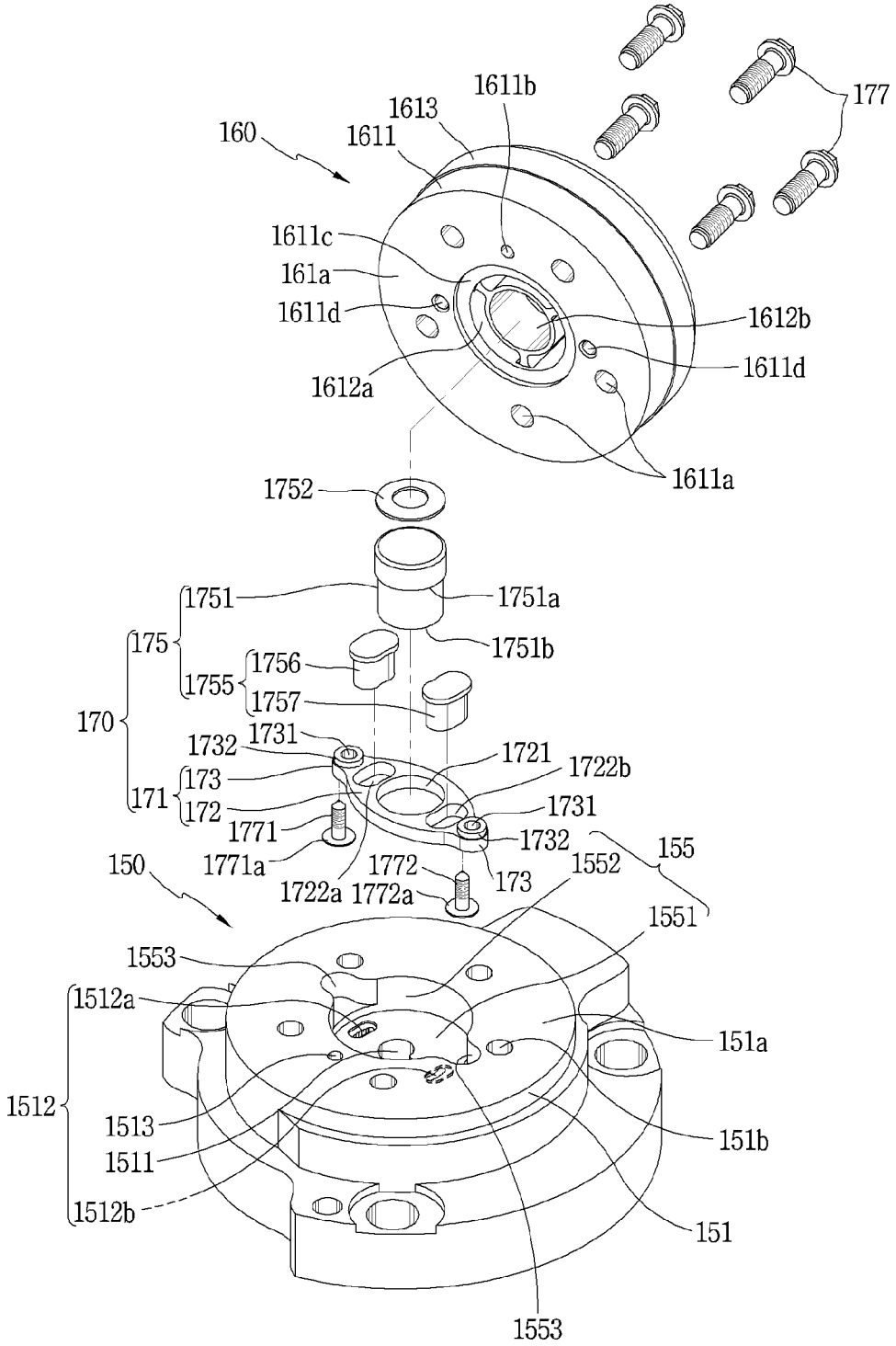
FIG. 2 is an exploded perspective view of a valve assembly in FIG. 1 according to an embodiment.

FIG. 1 is a longitudinal cross-sectional view illustrating an inner structure of a capacity-variable scroll compressor in accordance with an embodiment. FIG. 2 is an exploded perspective view illustrating a portion of a compression portion in FIG. 1.

A scroll compressor according to an embodiment may include a drive motor 120 constituting a motor disposed in a lower half portion of a casing 110, and a main frame 130, an orbiting scroll 140, a non-orbiting scroll 150, a back pressure chamber assembly 160, and a valve assembly 170 that constitute a compression part or portion disposed above the drive motor 120. The motor is coupled to one (first) end of a rotary shaft 125, and the compression portion is coupled to another (second) end of the rotary shaft 125. Accordingly, the compression portion may be connected to the motor by the rotary shaft 125 to be operated by a rotational force of the motor.

Referring to FIG. 1, the casing 110 according to embodiment may include a cylindrical shell 111, an upper cap 112, and a lower cap 113. The cylindrical shell 111 has a cylindrical shape with upper and lower ends open, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 described hereinafter may be coupled to the upper portion of the cylindrical shell 111, for example, above the drive motor 120.

The upper cap 112 may be coupled to cover an upper opening of the cylindrical shell 111. The lower cap 113 may be coupled to cover a lower opening of the cylindrical shell 111. A rim of a high/low pressure separation plate 115 described hereinafter may be inserted between the cylindrical shell 111 and the upper cap 112 to be, for example, welded on the cylindrical shell 111 and the upper cap 112. A rim of a support bracket 116 described hereinafter may be inserted between the cylindrical shell 111 and the lower cap 113 to be, for example, welded on the cylindrical shell 111 and the lower cap 113. Accordingly, the inner space of the casing 110 may be sealed.

The rim of the high/low pressure separation plate 115 may be welded on the casing 110 as described above. A central portion of the high/low pressure separation plate 115 may be bent and protrude toward an upper surface of the upper cap 112 so as to be disposed above the back pressure chamber assembly 160 described hereinafter. A refrigerant suction pipe 117 communicates with a space below the high/low pressure separation plate 115, and a refrigerant discharge pipe 118 communicates with a space above the high/low pressure separation plate 115. Accordingly, a low-pressure part or portion 110*a* constituting a suction space may be formed below the high/low pressure separation plate 115, and a high-pressure part or portion 110*b* constituting a discharge space may be formed above the high/low pressure separation plate 115.

In addition, a through hole 115*a* may be formed through a center of the high/low pressure separation plate 115. A sealing plate 1151 from which a floating plate 165 described hereinafter is detachable may be inserted into the through hole 115*a*. The low-pressure portion 110*a* and the high-pressure portion 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 may define an oil storage space 110*c* together with the lower portion of the cylindrical shell 111 constituting the low-pressure portion 110*a*. In other words, the oil storage space 110*c* is defined in the lower portion of the low-pressure portion 110*a*. The oil storage space 110*c* thus defines a portion of the low-pressure portion 110*a*.

Referring to FIG. 1, the drive motor 120 according to an embodiment is disposed in a lower half portion of the low-pressure portion 110*a* and may include a stator 121 and a rotor 122. The stator 121 may be, for example, shrink-fitted to an inner wall surface of the casing 111, and the rotor 122 may be rotatably provided inside of the stator 121. The stator 121 may include a stator core 1211 and a stator coil 1212.

The stator core 1211 may be formed in a cylindrical shape and may be shrink-fitted onto an inner circumferential surface of the cylindrical shell 111. The stator coil 1212 may be wound around the stator core 1211 and may be electrically connected to an external power source through a terminal (not illustrated) that is coupled through the casing 110.

The rotor 122 may include a rotor core 1221 and permanent magnets 1222. The rotor core 1221 may be formed in a cylindrical shape, and be rotatably inserted into the stator core 1211 with a preset or predetermined gap therebetween. The permanent magnets 1222 may be embedded in the rotor core 1222 at preset or predetermined intervals along a circumferential direction.

In addition, the rotary shaft 125 may be press-fitted to a center of the rotor core 1221. An orbiting scroll 140 described hereinafter may be eccentrically coupled to an upper end of the rotary shaft 125. Accordingly, the rotational force of the drive motor 120 may be transmitted to the orbiting scroll 140 through the rotary shaft 125.

An eccentric portion 1251 that is eccentrically coupled to the orbiting scroll 140 described hereinafter may be formed on an upper end of the rotary shaft 125. An oil pickup 126 that suctions up oil stored in the lower portion of the casing 110 may be disposed in or at a lower end of the rotary shaft 125. An oil passage 1252 may be formed through an inside of the rotary shaft 125 in the axial direction.

Referring to FIG. 1, the main frame 130 may be disposed on an upper side of the drive motor 120, and may be, for example, shrink-fitted to or welded on an inner wall surface of the cylindrical shell 111. The main frame 130 may include a main flange portion (main flange) 131, a main bearing portion (main bearing) 132, an orbiting space portion (orbiting space) 133, a scroll support portion (scroll support) 134, an Oldham ring support portion (Oldham ring support) 135, and a frame fixing portion 136.

The main flange portion 131 may be formed in an annular shape and accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 described hereinafter may protrude from an outer circumferential surface of the main flange portion 131 in the radial direction. An outer circumferential surface of the frame fixing portion 136 may be fixed in close contact with the inner circumferential surface of the casing 110. Accordingly, the main frame 130 may be fixedly coupled to the casing 110.

The main bearing portion 132 may protrude downward from a lower surface of a central part or portion of the main flange portion 131 toward the drive motor 120. A bearing hole 132*a* formed in a cylindrical shape may penetrate through the main bearing portion 132 in the axial direction. The rotary shaft 125 may be inserted into an inner circumferential surface of the bearing hole 132*a* and supported in the radial direction.

The orbiting space portion 133 may be recessed from the center portion of the main flange portion 131 toward the main bearing portion 132 to have a predetermined depth and outer diameter. The outer diameter of the orbiting space portion 133 may be larger than an outer diameter of a rotary shaft coupling portion 143 that is disposed on the orbiting scroll 140 described hereinafter. Accordingly, the rotary shaft coupling portion 143 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support the lower surface of an orbiting end plate 141 described hereinafter in the axial direction.

The Oldham ring support portion 135 may be formed in an annular shape on an upper surface of the main flange portion 131 along an outer circumferential surface of the scroll support portion 134. Accordingly, an Oldham ring 180 may be inserted into the Oldham ring supporting portion 135 to be pivotable.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 includes a plurality of protrusions along the circumferential direction.

Referring to FIG. 1, the orbiting scroll 140 according to an embodiment is coupled to the rotary shaft 125 to be disposed between the main frame 130 and the non-orbiting scroll 150. The Oldham ring 180, which is an anti-rotation mechanism, is disposed between the main frame 130 and the orbiting scroll 140. Accordingly, the orbiting scroll 140 performs an orbiting motion relative to the non-orbiting scroll 150 while its rotational motion is restricted.

The orbiting scroll 140 may include orbiting end plate 141, an orbiting wrap 142, and rotary shaft coupling portion 143. The orbiting end plate 141 is formed approximately in a disk shape. An outer diameter of the orbiting end plate 141 may be mounted on the scroll support portion 134 of the main frame 130 to be supported in the axial direction. Accordingly, the orbiting end plate 141 and the scroll support portion 134 facing it defines an axial bearing surface (no reference numeral given).

The orbiting wrap 142 is formed in a spiral shape by protruding from an upper surface of the orbiting end plate 141 facing the non-orbiting scroll 150 to a preset or predetermined height. The orbiting wrap 142 is formed to correspond to the non-orbiting wrap 152 to perform an orbiting motion by being engaged with a non-orbiting wrap 152 of the non-orbiting scroll 150 described hereinafter. The orbiting wrap 142 defines compression chambers V together with the non-orbiting wrap 152.

The compression chambers V may include first compression chamber V1 and second compression chamber V2 based on the orbiting wrap 142. Each of the first compression chamber V1 and the second compression chamber V2 may include a suction pressure chamber (not illustrated), an intermediate pressure chamber (not illustrated), and a discharge pressure chamber (not illustrated) that are continuously formed. Hereinafter, description will be given under the assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

The rotary shaft coupling portion 143 may protrude from a lower surface of the orbiting end plate 141 toward the main frame 130. The rotary shaft coupling portion 143 may be formed in a cylindrical shape, so that an orbiting bearing (not illustrated) configured as a bush bearing may be press-fitted thereto.

Referring to FIGS. 1 and 2, the non-orbiting scroll 150 according to an embodiment may be disposed on an upper portion of the main frame 130 with the orbiting scroll 140 interposed therebetween. The non-orbiting scroll 150 may be fixedly coupled to the main frame 130 or may be coupled to the main frame 130 to be movable up and down. This embodiment illustrates an example in which the non-orbiting scroll 150 is coupled to the main frame 130 to be movable relative to the main frame 130 in the axial direction.

The non-orbiting scroll 150 according to this embodiment may include a non-orbiting end plate 151, non-orbiting wrap 152, a non-orbiting side wall portion (non-orbiting side wall) 153, and a guide protrusion 154. The non-orbiting end plate 151 may be formed in a disk shape and disposed in the lateral direction in the low-pressure portion 110*a* of the casing 110. A plurality of back pressure fastening grooves 151*b* may be formed along an edge of the non-orbiting end plate 151. Accordingly, fastening bolts 177 that pass through back pressure fastening holes 1611*a* of a back pressure plate 161 described hereinafter may be fastened to the back pressure fastening grooves 151*b* of the non-orbiting end plate 151, such that the back pressure plate 161 may be fastened to a rear surface (upper surface) 151*a* of the non-orbiting end plate 151.

A discharge port 1511, bypass holes 1512, and a first back pressure hole 1513 may be formed through a central portion of the non-orbiting end plate 151 in the axial direction. The discharge port 1511 may be disposed at a center of the non-orbiting end plate 151, the bypass holes 1512 may be located at an outer side, that is, an upstream side, of the discharge port 1511, and the first back pressure hole 1513 may be located at an outer side, that is, an upstream side, of the bypass hole 1512.

The discharge port 1511 may be located at a position of which a discharge pressure chamber (no reference numeral given) of the first compression chamber V1 and a discharge pressure chamber (no reference numeral given) of the second compression chamber V2 communicate with each other. Accordingly, refrigerant compressed in the first compression chamber V1 and refrigerant compressed in the second compression chamber V2 may be combined in the discharge pressure chamber and discharged to the high-pressure portion 110*b* as a discharge space through the discharge port 1511.

The bypass holes 1512 may include first bypass hole 1512*a* and second bypass hole 1512*b*. Each of the first bypass hole 1512*a* and the second bypass hole 1512*b* may be provided as a single hole or may be provided as a plurality. This embodiment illustrates an example in which each of the first bypass hole 1512*a* and the second bypass hole 1512*b* is provided as a plurality. Accordingly, the bypass holes may be formed to be smaller than a wrap thickness of the orbiting wrap 142 and also an entire area of the bypass holes 1512 may be enlarged.

The first bypass hole 1512*a* may communicate with the first compression chamber V1 and the second bypass hole 1512*b* may communicate with the second compression chamber V2. The first bypass hole 1512*a* and the second bypass hole 1512*b* may be formed at both sides of the discharge port 1511 in the circumferential direction with the discharge port 1511 located at the center, in other words, formed at a suction side rather than the discharge port 1511. Accordingly, when refrigerant is overcompressed in each of the compression chambers V1 and V2, the refrigerant may be bypassed in advance before reaching the discharge port 1511, thereby suppressing or preventing the overcompression.

Both the first bypass hole 1512*a* and the second bypass hole 1512*b* are accommodated in a valve accommodating groove 155 described hereinafter. In other words, the valve accommodating groove 155 is recessed by a preset or predetermined depth into the rear surface 151*a* of the non-orbiting end plate 151, and the first bypass hole 1512*a* and the second bypass hole 1512*b* are formed inside of the valve accommodating groove 155 together with the discharge port 1511. Accordingly, each length L2 of the first bypass hole 1512*a* and the second bypass hole 1512*b* may be reduced by a value obtained by subtracting a depth D1 of the valve accommodating groove 155 from a thickness H1 of the non-orbiting end plate 151, which may result in decreasing dead volumes in the first bypass hole 1512*a* and the second bypass hole 1512*b*. The valve accommodating groove 155 will be described hereinafter together with a valve guide 171.

The first back pressure hole 1513 may be formed through the non-orbiting end plate 151 in the axial direction, so as to communicate with a compression chamber V that forms an intermediate pressure between a suction pressure and a discharge pressure. The first back pressure hole 1513 may be provided as one to communicate with any one of the first compression chamber V1 or the second compression chamber V2, or may be provided as a plurality to communicate with both of the first and second compression chambers V1 and V2, respectively.

The non-orbiting wrap 152 may extend axially from a lower surface of the non-orbiting end plate 151. The non-orbiting wrap 152 may be formed in a spiral shape inside of the non-orbiting side wall portion 153 to correspond to the orbiting wrap 142 so as to be engaged with the orbiting wrap 142.

The non-orbiting side wall portion 153 may extend in an annular shape from a rim of a lower surface of the non-orbiting end plate 151 in the axial direction to surround the non-orbiting wrap 152. A suction port 1531 may be formed through one side of an outer circumferential surface of the non-orbiting side wall portion 153 in the radial direction. Accordingly, each of the first compression chamber V1 and the second compression chamber V2 compresses suctioned refrigerant as its volume decreases from an outer side to a center.

The guide protrusion 154 may extend radially from an outer circumferential surface of a lower side of the non-orbiting side wall portion 153. The guide protrusion 154 may be formed as a single annular shape or may be provided as a plurality disposed at preset or predetermined distances in the circumferential direction. This embodiment will be mainly described based on an example in which a plurality of guide protrusions 154 is disposed at preset or predetermined distances along the circumferential direction.

Referring to FIG. 1, the back pressure chamber assembly 160 according to an embodiment may be disposed at an upper side of the non-orbiting scroll 150. Accordingly, back pressure of a back pressure chamber 160*a* (to be precise, a force that the back pressure applies to the back pressure chamber) is applied to the non-orbiting scroll 150. In other words, the non-orbiting scroll 150 is pressed toward the orbiting scroll 140 by the back pressure to seal the compression chambers V1 and V2.

The back pressure chamber assembly 160 may include back pressure plate 161 and floating plate 165. The back pressure plate 161 may be coupled to an upper surface of the non-orbiting end plate 151. The floating plate 165 may be slidably coupled to the back pressure plate 161 to define the back pressure chamber 160*a* together with the back pressure plate 161.

The back pressure plate 161 may include a fixed plate portion (fixed plate) 1611, a first annular wall portion (first annular wall) 1612, and a second annular wall portion (second annular wall) 1613. The fixed plate portion 1611 may be in the form of an annular plate with a hollow center. A plurality of back pressure fastening holes 1611*a* may be formed along an edge of the fixed plate portion 1611. Accordingly, the fixed plate portion 1611 may be fastened to the non-orbiting scroll 150 by the fastening bolts 177 inserted through the back pressure fastening holes 1611*a*.

A plate-side back pressure hole (hereinafter, referred to as a "second back pressure hole") 1611*b* may be formed through the fixed plate portion 1611 in the axial direction. The second back pressure hole 1611*a* may communicate with the compression chamber V through the first back pressure hole 1513. Accordingly, the compression chamber V and the back pressure chamber 160*a* may communicate with each other through the second back pressure hole 1611*a* as well as the first back pressure hole 1513.

A discharge guide groove 1611*c*, which will be described hereinafter, may be formed in the lower surface of the fixed plate portion 1611, that is, in the rear surface 161*a* of the back pressure plate 161 facing the rear surface 151*a* of the non-orbiting end plate 151. The discharge guide groove 1611*c* may be formed in an annular shape to surround an intermediate discharge port 1612*a* described hereinafter, and may be formed such that the intermediate discharge port 1612*a* continuously communicates with an inner circumference of the discharge guide groove 1611*c*. Accordingly, refrigerant flowing into the discharge guide groove 1611*c* may quickly move to the high-pressure portion 110*b* through the intermediate discharge port 1612*a*. The discharge guide groove 1611*c* will be described hereinafter together with the valve assembly 170.

The first annular wall portion 1612 and the second annular wall portion 1613 may be formed on an upper surface of the fixed plate portion 1611 to surround inner and outer circumferential surfaces of the fixed plate portion 1611. Accordingly, the back pressure chamber 160*a* formed in the annular shape may be defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may include an intermediate discharge port 1612*a* that communicates with the discharge port 1511 of the non-orbiting scroll 150. A valve guide groove 1612*b* into which a discharge valve 1751 may be slidably inserted may be formed at an inner side of the intermediate discharge port 1612*a*. A backflow prevention hole 1612*c* may be formed in a center of the valve guide groove 1612*b*. Accordingly, the discharge valve 1751 may be selectively opened and closed between the discharge port 1511 and the intermediate discharge port 1612*a* to suppress or prevent discharged refrigerant from flowing back into the compression chambers V1 and V2.

The floating plate 165 may be formed in an annular shape. The floating plate 165 may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on the pressure of the back pressure chamber 160*a*. For example, when the floating plate 165 is brought into contact with the high/low pressure separation plate 115, the floating plate 165 serves to seal the low-pressure portion 110*a* such that the discharged refrigerant is discharged to the high-pressure portion 110*b* without leaking into the low-pressure portion 110*a*.

Referring to FIGS. 1 and 2, the back pressure chamber assembly 170 according to an embodiment may be disposed between the non-orbiting scroll 150 and the back pressure chamber assembly 160. The valve assembly 170 may be manufactured separately from the back pressure chamber assembly 160 to be fixed between the non-orbiting scroll 150 and the back pressure chamber assembly 160, or may be coupled to or integrally formed with the back pressure chamber assembly 160 to be fixed between the orbiting scroll 150 and the back pressure chamber assembly 160. In this embodiment, an example in which the valve assembly 170 is manufactured separately from the back pressure chamber assembly 160 and fixed between the non-orbiting scroll 150 and the back pressure chamber assembly 160 will be described first.

Also, the valve assembly 170 may include discharge valve 1751 and a bypass valve 1755, or may include only the bypass valve 1755 excluding the discharge valve 1751. However, depending on the shape of a discharge valve 1751, the discharge valve 1751 may also be described as being included in the valve assembly 170. For example, when the discharge valve 1751 is configured as a reed valve and fastened to retainer block 171, the discharge valve 1751 may also be described as being included in the valve assembly 170. In this embodiment, the discharge valve 1751 is slidably inserted into the valve guide groove 1612*b* that is disposed in the back pressure plate 161, and the bypass valve 1755 is fixed to the retainer block 171 described hereinafter. Thus, it will be described in this embodiment that only the bypass valve 1755 is included in the valve assembly 170.

In addition, the valve assembly 170 may be fixedly inserted into the block insertion groove 155 of the non-orbiting end plate 151. In other words, the block insertion groove 155 may not be included in the valve assembly 170 but is a portion into which the valve assembly 170 is inserted. Thus, in broad terms, the block insertion groove 155 may also be included in the valve assembly 170. Therefore, in the following description, the block insertion groove 155 will be described separately from the valve assembly 170, but the portion thereof that is related to the valve assembly 170 will also be described as a portion of the valve assembly 170.

Figure 3:
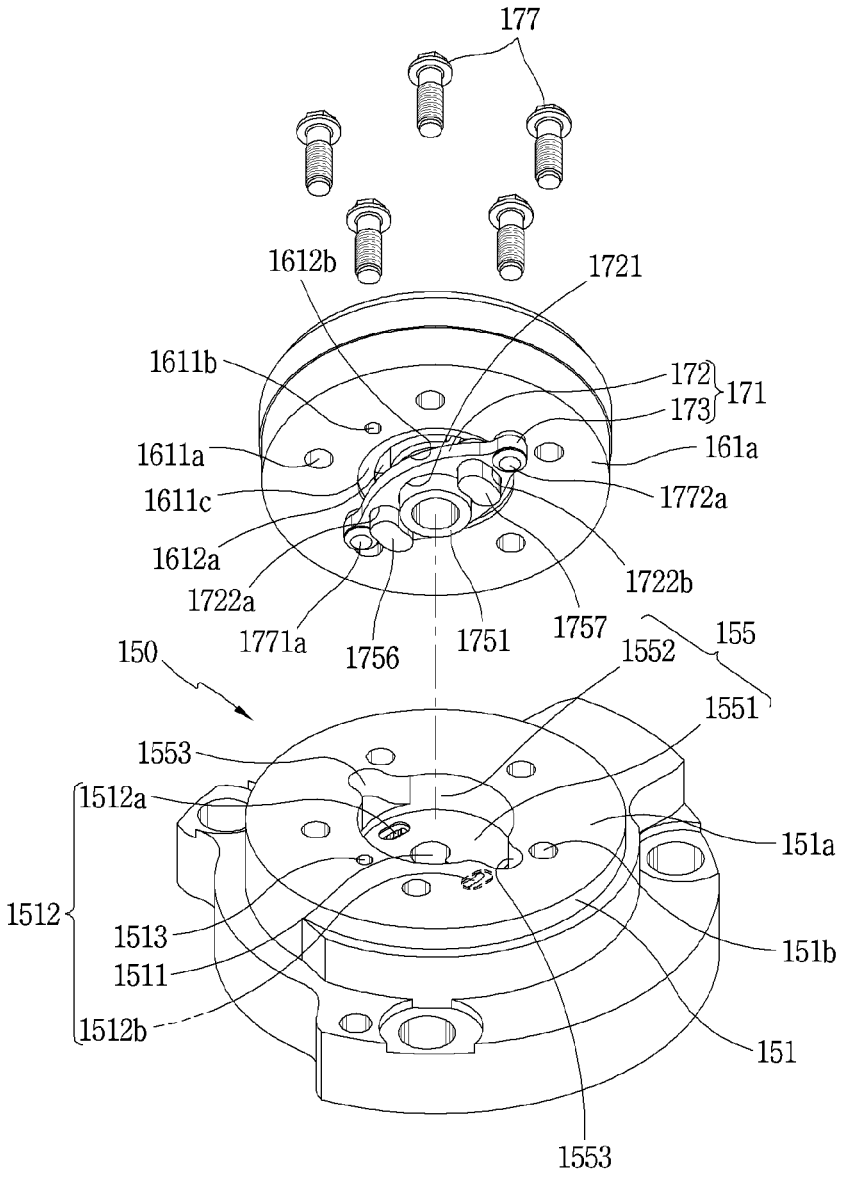
FIG. 3 is a perspective view illustrating a state in which the valve assembly is assembled with a back pressure chamber assembly.
Figure 4:
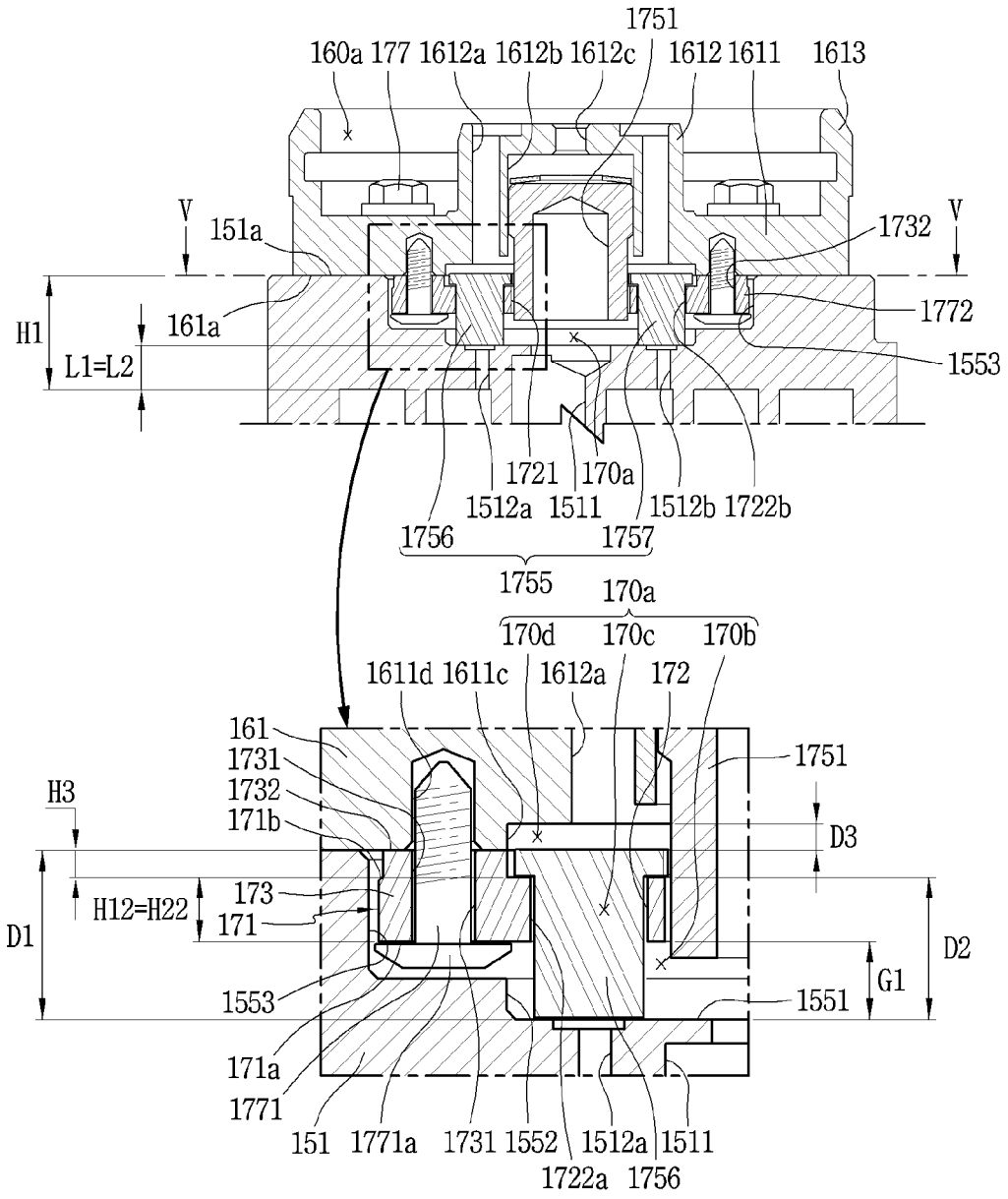
FIG. 4 is a cross-sectional view illustrating a state in which the back pressure chamber assembly is assembled with a non-orbiting scroll in FIG. 3.
Figure 5:
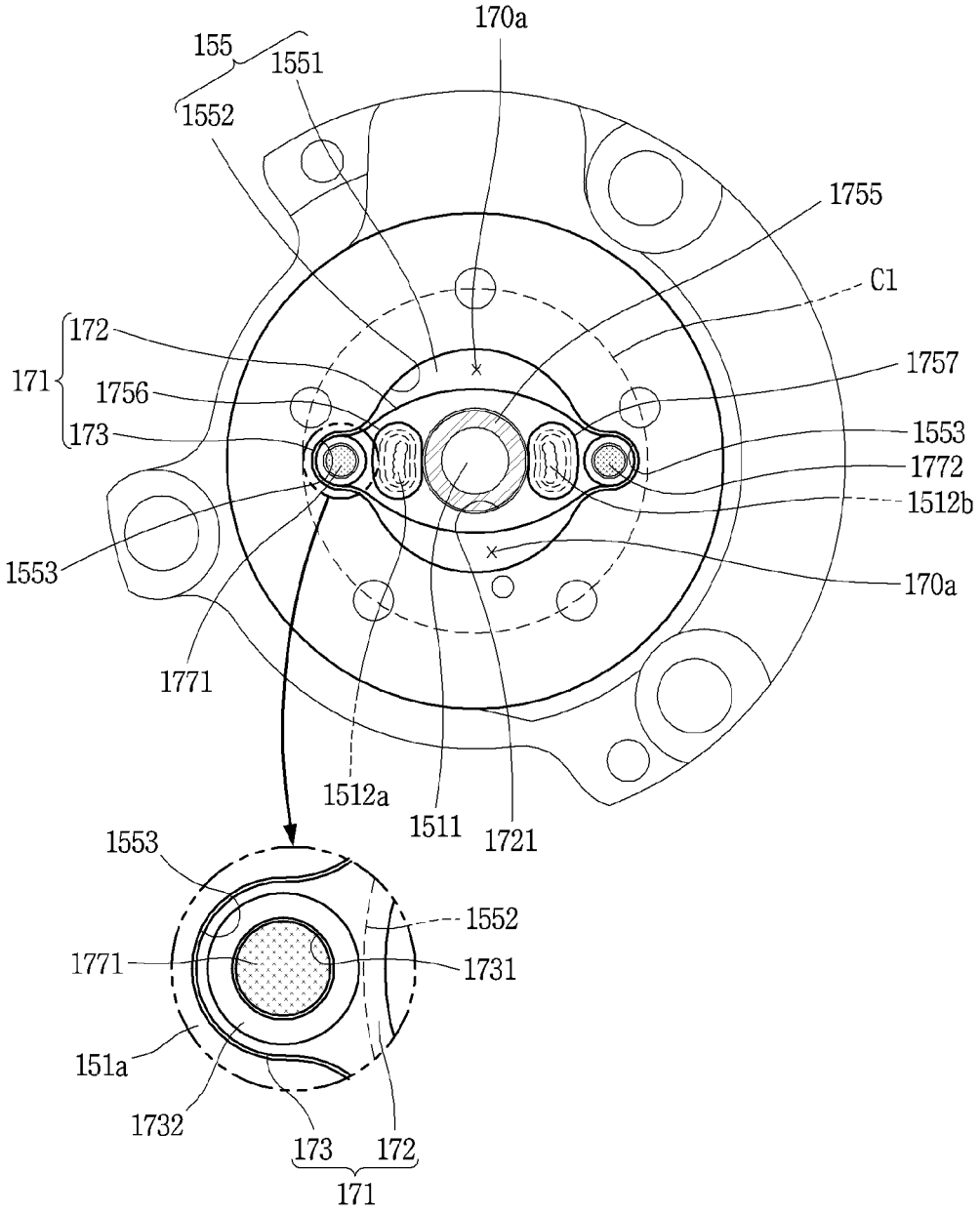
FIG. 5 is a cross-sectional view, taken along line "V-V" of FIG. 4.
Figure 6:
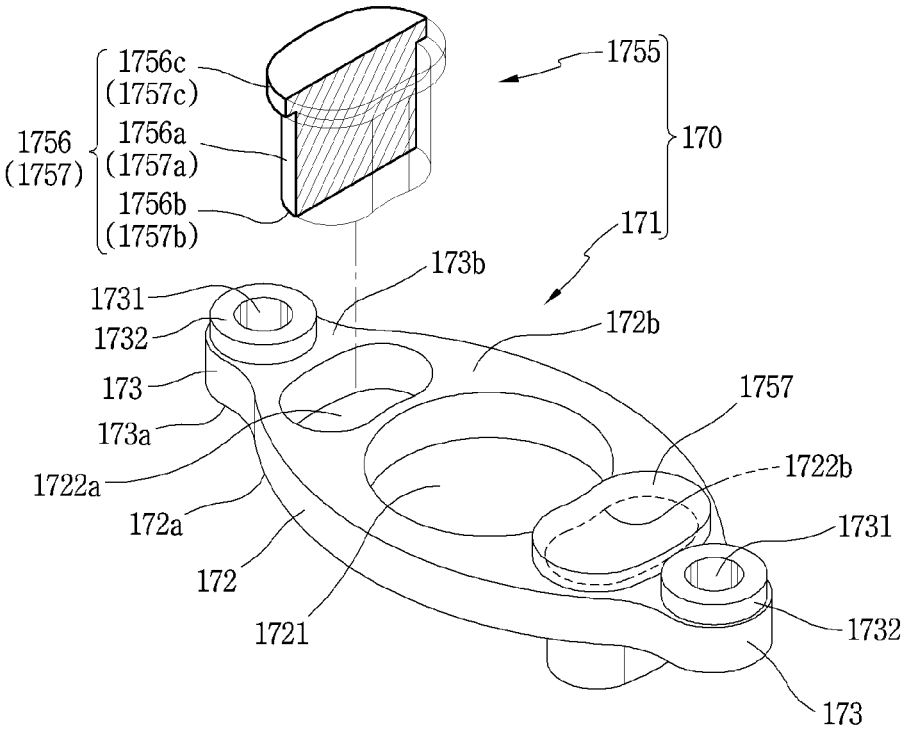
FIG. 6 is an enlarged perspective view illustrating a valve guide and a bypass valve in FIG. 2.

FIG. 3 is a perspective view illustrating a state in which the valve assembly is assembled with the back pressure chamber assembly. FIG. 4 is a cross-sectional view illustrating a state in which the back pressure chamber assembly is assembled with a non-orbiting scroll in FIG. 3. FIG. 5 is a cross-sectional view, taken along line "V-V" of FIG. 4. FIG. 6 is an enlarged perspective view illustrating a valve guide and a bypass valve in FIG. 2.

Referring to FIGS. 3 and 4, the valve accommodating groove 155 according to this embodiment may be recessed by a preset or predetermined depth into the rear surface 151*a* of the non-orbiting end plate 151. For example, the valve accommodating groove 155 may include a valve seating surface 1551 defining a bottom surface, and a guide accommodating surface 1552 that surrounds the valve seating surface 1551. In other words, the valve seating surface 1551 according to this embodiment forms the valve accommodating groove 155, but is spaced apart from the first axial side surface 171*a* of the valve guide 171 by a preset or predetermined gap to define a portion of the discharge guide passage 170*a*. Accordingly, refrigerant that passes through the discharge port 1511 and the bypass holes 1512*a* and 1512*b* moves to the intermediate discharge port 1612*a* through the discharge guide passage 170*a* that is defined by the gap between the valve seating surface 1551 and the valve guide 171.

The valve seating surface 1551 may be formed flat, and the discharge port 1511 and bypass holes 1512*a* and 1512*b* described above may be respectively formed through the valve seating surface 1551. In other words, the discharge port 1511 and the bypass holes 1512*a* and 1512*b* may be formed through the valve seating surface 1551 in the axial direction. Accordingly, the discharge port 1511 and the bypass holes 1512*a* and 1512*b* may be located inside of the valve accommodating groove 155.

Figure 7:
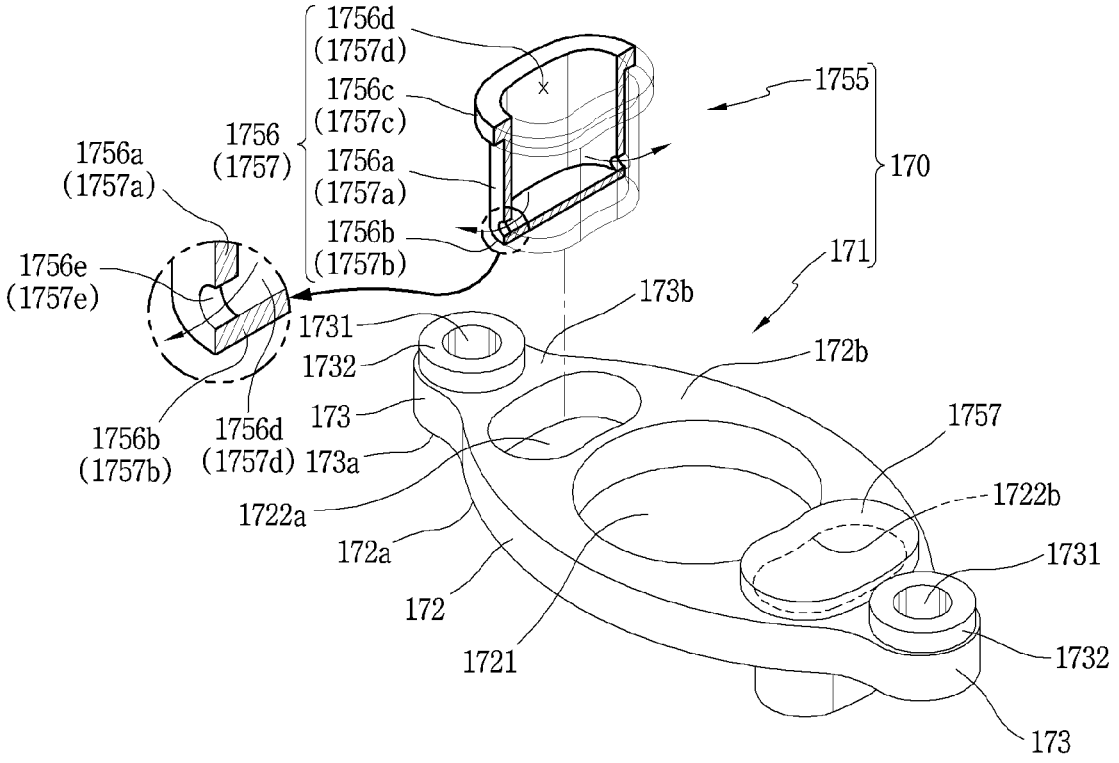
FIG. 7 is a cutout perspective view of the bypass valve in FIG. 3 according to another embodiment.

When the discharge port 1511 and the bypass holes 1512*a* and 1512*b* are formed inside of the valve accommodating groove 155, a length L1 of the discharge port 1511 and a length of each bypass hole 1512*a* and 1512*b* may be shortened, as illustrated in FIG. 7. Accordingly, depending on a shape of a discharge valve 1751 and/or bypass valves 1755, a dead volume in the discharge port 1511 and/or the bypass holes 1512*a* and 1512*b* may be reduced. For example, in a case in which the bypass valves 1755 are piston valves that are opened and closed by being brought into contact with or spaced apart from the valve seating surface 1552, which defines the upper surfaces of the bypass holes 1512*a* and 1512*b*, the bypass holes 1512*a* and 1512*b* may be shortened, and thus have reduced volumes, such that the dead volume thereof may decrease. This is equally expected even in a case in which the bypass valves 1755 are configured as reed valves.

Referring to FIG. 5, the guide accommodating surface 1552 may be formed at a position at which it does not overlap the back pressure fastening grooves 151*b*. In other words, the plurality of back pressure fastening grooves 151*b* that fastens the back pressure plate 161 to the non-orbiting scroll 150 may be formed in the rear surface 151*a* of the non-orbiting end plate 151 in a manner such that the guide accommodating surface 1552 defining an inner circumferential surface of the valve accommodating groove 155 is located within a first virtual circle C1 that connect centers of the back pressure fastening grooves 151*b* in the circumferential direction. Accordingly, the back pressure fastening grooves 151*b* may be located outside of the valve accommodating groove 155, and thus, may be formed deeply even if a thickness of the non-orbiting end plate 151 in the valve accommodating groove 155 becomes thin. This may secure a fastening strength of the fastening bolts 177.

However, a portion of the valve accommodating groove 155, for example, guide fixing protrusions 173 that fastens the bypass valves 1755 described hereinafter may be formed outside of the first virtual circle C1 to be located between adjacent back pressure fastening grooves 151*b* in the circumferential direction. Accordingly, the guide fixing protrusions 173 may be increased in length so as to enhance assembly stability for the valve guide 171.

Referring to FIG. 4, a height of the guide accommodating surface 1552, that is, a depth D1 of the valve accommodating groove 155, which is a distance from the rear surface 151*a* of the non-orbiting end plate 151 to the valve seating surface 1551 is larger than a thickness H2 of the valve guide 171, which is a distance between both axial side surfaces 171*a* and 171*b* of the valve guide 171 described hereinafter. Accordingly, when the second axial side surface 171*b* of the valve guide 171 described hereinafter has a same height as the rear surface 151*a* of the non-orbiting end plate 151, the first axial side surface 171*a* of the valve guide 171 and the valve seating surface 1551 are spaced apart from each other by a preset or predetermined distance to define a portion of the discharge guide passage 170*a*, that is, a first discharge guide passage 170*b*.

A cross-sectional area of the valve accommodating groove 155 may be wider than a cross-sectional area of the valve guide 171, more specifically, a cross-sectional area of a guide main body 172 of the valve guide 171 that is inserted into the valve accommodating groove 155. For example, as illustrated in FIGS. 3 and 5, the guide accommodating surface 1552 defining the inner circumferential surface of the valve accommodating groove 155 may be formed in a circular shape, and an outer circumferential surface of the valve guide 171 described hereinafter may be formed in an elliptical shape. In this case, an inner diameter of the guide accommodating surface 1552 may be larger than a minor axial length of the valve guide 171. Accordingly, the inner circumferential surface of the guide accommodating surface 1552 is spaced apart from the outer circumferential surface of the valve guide 171 to define another portion of the discharge guide passage 170*a*, namely, a second discharge guide passage 170*c*.

Referring to FIGS. 3 to 5, guide insertion grooves 1553 may be formed in portions of the guide accommodating surface 1552. For example, the guide insertion grooves 1553 may be formed in both sides of the guide accommodating surface 1552 with respect to the discharge port 1511, more precisely, recessed outward from the guide accommodating surface 1552 on a virtual line, which passes through the discharge port 1511 and connects a center of the first bypass hole 1512*a* and a center of the second bypass hole 1512*b*. The guide insertion grooves 1553 may be symmetrical with respect to each other with the discharge port 1511 as a center. Accordingly, the guide insertion grooves 1553 may extend from the inner circumferential surface of the valve accommodating groove 155 to be located at an outside of the valve accommodating groove 155.

The guide insertion grooves 1553 may have a thickness that is thinner than or equal to that of the valve accommodating groove 155. For example, a depth D2 of the guide insertion groove 1553 may be thinner than or equal to the depth D1 of the valve accommodating groove 155. Accordingly, heads 1771*a* and 1772*a* of fastening members 1771 and 1772 described hereinafter that are fastened in a direction from the first axial side surface 171*a* to the second axial side surface 171*b* of the valve guide 171 may be brought into contact with bottom surfaces of the guide insertion grooves 1553, and the valve guide 171 may be spaced apart from the valve seating surface 1551 by the heads 1771*a* and 1772*a* of the fastening members 1771 and 1772, thereby defining the first discharge guide passage 170*b*.

Referring to FIGS. 4 and 6, the valve assembly 170 according to an embodiment may include a valve guide 171 and a valve member (valve) 175. The valve guide 171 may be fixedly inserted into the valve accommodating groove 155 formed in the non-orbiting end plate 151, and the valve member 175 may slide into the valve guide 171 to be located between the non-orbiting end plate 151 and the back pressure plate 161. Accordingly, the valve guide 171 and the valve member 175 may be modularized into the valve assembly 170, which may simplify assembly of the valve member 175, that is, the bypass valves 1755.

In addition, the valve guide 171 may be fastened to the back pressure chamber assembly 160 or to the non-orbiting scroll 150. Alternatively, the valve guide 171 may be fixedly pressed between the non-orbiting scroll 150 and the back pressure chamber assembly 160. In this embodiment, an example in which the valve guide 171 is fixedly pressed between the non-orbiting scroll 150 and the back pressure chamber assembly 160 will be described.

Referring to FIGS. 4 to 6, the valve guide 171 according to this embodiment may include a guide main body 172 and guide fixing protrusions 173. The guide main body 172 and the guide fixing protrusions 173 may be formed to have a same thickness. The guide main body 172 may be located inside of the valve accommodating groove 155 and the guide fixing protrusions 173 may be located outside of the valve accommodating groove 155.

The guide main body 172 may be inserted into the valve accommodating groove 155. When projected in the axial direction, a cross-sectional area of the guide main body 172 may be smaller than that of the valve accommodating groove 155. Accordingly, an outer circumferential surface of the guide main body 172 may be spaced apart from the inner circumferential surface of the valve accommodating groove 155, so that the second discharge guide passage 170*c* is defined between the inner circumferential surface of the valve accommodating groove 155 and the outer circumferential surface of the guide main body 172. With this configuration, even if the guide main body 172 is located between the bypass holes 1512*a* and 1512*b* (and the discharge port) and the intermediate discharge port 1612*a*, refrigerant that has passed through the bypass holes 1512*a* and 1512*b* (and the discharge port) may smoothly flow to the intermediate discharge port 1612*a* through the second discharge guide passage 170*c*.

For example, the guide main body 172 may be formed in an elliptical shape, and a minor axial length of the guide main body 172 may be smaller than the inner diameter of the valve accommodating groove 155 formed in the circular shape. This may result in defining the second discharge guide passage 170*c* between the outer circumferential surface of the guide main body 172 and the inner circumferential surface of the valve accommodating groove 155.

Although not illustrated in the drawings, the guide main body 172 may be formed in a circular shape having a same center as the valve accommodating groove 155, and an outer diameter of the guide main body 172 may be smaller than the inner diameter of the valve accommodating groove 155, so as to define the second discharge guide passage 170*c*. Through this, bypass valve guide hole 1722 described hereinafter may be formed long while reducing the inner diameter of the valve accommodating groove 155. This may elongate the guide fixing protrusions 173, so that the valve guide 171 may be stably fastened or the valve guide 171 may be stably fixed by being pressed between the valve guide 171 and the non-orbiting scroll 150 without separate fastening members.

In addition, although not illustrated in the drawings, the guide main body 172 may be formed in a circular shape with the same center as the valve accommodating groove 155, and the outer diameter of the guide main body 172 may also be the same as the inner diameter of the valve accommodating groove 155. In this case, the second discharge guide passage 170*c* may be defined in the outer circumferential surface of the guide main body 172 and/or the inner circumferential surface of the valve accommodating groove 155.

A discharge valve guide hole 1721 may be formed in the center of the guide main body 172. The discharge valve guide hole 1721 may be formed to correspond to the shape of the discharge valve 1751. For example, when an outer circumferential surface of the discharge valve 1751 is formed in a circular shape, the discharge valve guide hole 1721 may also be formed in a circular shape. Accordingly, the discharge valve 1751 inserted into the discharge valve guide hole 1721 may slide along the axial direction in the discharge valve guide hole 1721 to open and close the discharge port 1511.

Bypass valve guide holes 1722 may be formed in both edges of the guide main body 172, respectively. The bypass valve guide holes 1722 may be formed in both sides of the discharge valve guide hole 1721 at preset or predetermined distances.

The bypass valve guide holes 1722 may be formed to correspond to the shape of the bypass valves 1755, that is, the shape of the bypass holes 1512*a* and 1512*b*. For example, when each bypass hole 1512*a*, 1512*b* communicates with one compression chamber V1, V2 and is provided as a plurality continuously, each bypass valve 1755 may be formed in an arcuate shape when projected in the axial direction. In this case, the bypass valve guide holes 1722 may also be formed to have an arcuate cross-section so that the bypass valves 1755 may be slidably inserted therein.

The guide fixing protrusions 173 may extend from both ends of the guide main body 172. For example, the guide fixing protrusions 173 may extend in a major axial direction from both ends in the major axial direction of the guide main body 172 formed in the elliptical shape. As the guide fixing protrusions 173 extend to the outside of the valve accommodating groove 155, the first axial side surface 172*a* of the guide main body 172 may be supported by the guide fixing protrusions 173 while being spaced apart from the valve seating surface 1551.

Referring to FIGS. 4 to 6, the guide fixing protrusions 173 may be formed in substantially the same shape as the guide insertion grooves 1553 in the axial direction. Accordingly, the guide fixing protrusions 173 may be supported by being axially inserted into the guide insertion grooves 1553, respectively.

Guide fastening holes 1731 may be formed through the guide fixing protrusions 173, respectively, in the axial direction. The guide fastening holes 1731 may be formed to correspond respectively to guide fastening grooves 1611*d* that are formed in the rear surface 161*a* of the back pressure plate 161. In other words, the guide fastening holes 1731 may be located on a same axis as the guide fastening grooves 1611*d*. Accordingly, the valve guide 171 may be fastened to the back pressure plate 161 by the plurality of fastening members 1771 and 1772 that are fastened to the guide fastening grooves 1611*d* of the back pressure plate 161 through the guide fastening holes 1731 of the valve guide 171.

The guide fixing protrusions 173 may come into close contact with the back pressure plate 161 or may be spaced apart therefrom by a preset or predetermined distance. For example, a second axial side surface 173*b* of each of the guide fixing protrusions 173 may be formed flat to have a same height as the second axial side surface 172*b* of the guide main body 172, so as to come into close contact with the rear surface 161*a* of the back pressure plate 161, or a guide separation protrusion 1732 may be formed on the second axial side surface 173*b* of the guide fixing protrusion 173 so that the second axial side surface 173*b* of the guide fixing protrusion 173 may be spaced apart from the rear surface 161*a* of the back pressure plate 161 by a height of the guide separation protrusion 1732. In this embodiment, an example in which the guide separation protrusion 1732 is formed on the second axial side surface 173*b* of the guide fixing protrusion 173 is illustrated. Accordingly, a discharge guide groove 1611*c*, which will be described hereinafter, may be formed shallowly in the rear surface 161*a* of the back pressure plate 161, so that the length of the valve guide groove may extend and the discharge valve 1751 may be stably supported accordingly. This will be described hereinafter together with the discharge guide groove 1611*c*.

As illustrated in FIGS. 5 and 6, the guide separation protrusion 1732 may be formed in a circular shape. For example, the guide separation protrusion 1732 may extend from the second axial side surface 173*b* of the guide fixing protrusion 173 toward the rear surface 161*a* of the back pressure plate 161, and the guide fastening hole 1731 may be formed through the guide separation protrusion 1732 in the axial direction. Accordingly, the guide separation protrusion 1732 may be formed in a circular shape to surround the guide fastening hole 1731. Through this, an end surface of the guide separation protrusion 1732 becomes higher than the second axial side surface 172*b* of the guide main body 172, and thus, a discharge guide passage (third discharge guide passage) 170*d* is defined between the second axial side surface 172*b* of the guide main body 172 and the rear surface 161*a* of the back pressure plate 161 facing the second axial side surface 172*b*.

Although not illustrated, the guide separation protrusions 1732 may alternatively be formed in an arcuate shape. In this case, the guide separation protrusions 1732 may be formed to cover only portions of the guide fastening holes 1731, respectively.

Referring to FIG. 4, a height H2 of each guide separation protrusion 1732 may be shallower than a thickness of the guide fixing protrusion 173, in other words, shorter than or equal to a gap G1 between the valve seating surface 1551 as the bottom surface of the valve accommodating groove 155 and the first axial side surface 172*a* of the guide main body 172 facing the valve seating surface 1551. This may result in securing a sufficient opening width of the first discharge guide passage 170*b* of the first discharge guide passage 170*b* which is defined by the gap G1 between the valve seating surface 1551 and the first axial side surface 172*a*. If the height H2 of the guide separation protrusion 1732 is too high under a condition that the depth D1 of the valve accommodating groove 155 is the same, the guide main body 172 may be located close to the valve seating surface 1551 by that much, which may make it difficult to secure a sufficient opening width of the first discharge guide passage 170*b*. However, as in this embodiment, when the height H2 of the guide separation protrusion 1732 is smaller (shallower) than the thickness of the guide fixing protrusion 173, that is, the thickness H2 of the valve guide 171, an opening width of the third discharge guide passage 170*d* as well as an opening area of the first discharge guide passage 170*b* may be secured.

In addition, as a height H3 of the guide separation protrusion 1732 is formed smaller than a thickness H22 of the guide fixing protrusion 173, the opening/closing surface (opening/closing portion) of the bypass valve 1755 may be located at a same height as that of the first axial side surface 172*a* of the guide main body 172 or may be located lower than the first axial side surface 172*a*, at a position where the bypass valve 1755 is fully open. Accordingly, the bypass valves 1755 may be stably supported by the bypass valve guide holes 1722 even at the fully open position.

Referring to FIGS. 3 and 4, the discharge guide groove 1611*c* described above may be formed in the rear surface 161*a* of the back pressure plate 161. A depth D3 of the discharge guide groove 1611*c* may be larger than or equal to the thicknesses of a stopper 1756*c* and a second stopper 1757*c* described hereinafter. This may result in securing a maximum opening/closing height of the bypass valves 1755 while securing a maximum thickness of the valve guide 171.

The discharge guide groove 1611*c* may be formed in an annular shape and communicate with the intermediate discharge port 1612*a*. In other words, the intermediate discharge port 1612*a* may be continuously formed in an inner circumferential side of the discharge guide groove 1611*c*. Accordingly, refrigerant flowing into the discharge guide groove 1611*c* may move quickly toward the intermediate discharge port 1612*a*.

In addition, the discharge guide groove 1611*c* may be wider than the outer circumferential surface of the guide main body 172 when projected in the axial direction, that is, an outer circumferential surface of the discharge guide groove 1611*c* may be almost the same as an inner diameter of the guide accommodating surface 1552 that defines the inner circumferential surface of the valve accommodating groove 155. Accordingly, the discharge guide groove 1611*c* is located outside of the guide main body 172, so that the intermediate discharge port 1612*a* always maintains communication with the second discharge guide passage 170*c* through the discharge guide groove 1611*c*.

Referring to FIGS. 2 to 6, the valve member 175 according to this embodiment may include the discharge valve 1751 and the bypass valves 1755. Both of the discharge valve 1751 and the bypass valves 1755 may be piston valves. However, embodiments are not limited thereto. In other words, the bypass valve 1755 may be a piston valve, and the discharge valves 1751 may be reed valves. However, as described above, this embodiment will be described based on an example in which both the discharge valve 1751 and the bypass valves 1755 are piston valves.

The discharge valve 1751 axially slides into the valve guide groove 1612*a* of the back pressure plate 161 and the discharge valve guide hole 1721 of the valve guide 171, to open and close the discharge port 1511. Accordingly, the discharge valve 1751 is always accommodated in the valve accommodating groove 155. For example, as a lower end of the discharge valve 1751 remains inserted into the discharge valve guide hole 1721 even when the discharge valve 1751 is closed as well as open, the discharge valve 1751 is always located inside of the valve accommodating groove 155.

Referring to FIG. 2, the discharge valve 1751 may be formed in a shape of a rod or cylinder. In other words, the discharge valve 1751 may be formed in a solid rod shape or a hollow cylindrical shape. The discharge valve 1751 of this embodiment may be formed in a semi-circular rod or semi-cylindrical shape with an upper end closed and a lower end open. This may reduce a weight of the discharge valve 1751 and simultaneously prevent oil in the high-pressure portion 110*b*, which is a discharge space, from stagnating inside of the discharge valve 1751.

A valve support portion 1751*a* may be defined on an outer circumferential surface of the discharge valve 1751. For example, the valve support portion 1751*a* may be formed at a middle of the outer circumferential surface of the discharge valve 1751, and thus, an outer diameter of the discharge valve 1751 at a side toward the opening/closing surface 1751*b* may be larger than an outer diameter at an opposite side.

The valve support portion 1751*a* may be stepped such that its outer diameter at the valve support portion 1751*a* is larger than an inner diameter of the discharge valve guide hole 1721 formed in the valve guide 171. Accordingly, the valve support portion 1751*a* of the discharge valve 1751 may be caught on the second axial side surface 171*b* of the valve guide 171, so as to suppress the discharge valve 1751 from moving in the axial direction toward the non-orbiting scroll 150. Through this, the discharge valve 1751 may be modularized together with first bypass valve 1756 and second bypass valve 1757 described hereinafter and coupled to the back pressure chamber assembly 160 by the valve guide 171.

Although not illustrated, the discharge valve 1751 may alternatively be formed in a semi-circular rod or semi-cylindrical shape with an upper end open and a closed lower end. In this case, a weight of the discharge valve 1751 may be reduced, and the opening/closing surface of the discharge valve 1751 may be close to the discharge port 1511, thereby decreasing a dead volume. However, in this case, an oil discharge hole (not illustrated) may be formed near the opening/closing surface 1751*b* of the discharge valve 1751 to penetrate through between inner and outer circumferential surfaces of the discharge valve 1751, thereby preventing stagnation of oil in the discharge valve 1751.

Referring to FIGS. 4 and 6, the bypass valves 1755 axially slide into the bypass valve guide holes 1722 of the valve guide 171 to open and close the bypass holes 1512*a* and 1512*b*. Accordingly, the bypass valves 1755 are always accommodated in the valve accommodating groove 155 like the discharge valve 1751. For example, as lower ends of the bypass valves 1755 remain inserted into the bypass valve guide holes 1722 even when the bypass valves 1755 are closed as well as open, the bypass valves 1755 are always located inside the valve accommodating groove 155.

The bypass valves 1755 may include first bypass valve 1756 and second bypass valve 1757. In other words, the first bypass hole 1512*a* may be opened and closed by the first bypass valve 1756, and the second bypass hole 1512*b* may be opened and closed by the second bypass valve 1757, respectively.

The first bypass valve 1756 may include a first guide portion (guide) 1756*a*, a first opening/closing portion 1756*b*, and a first stopper 1756*c*. The first guide portion 1756*a* is a portion that guides axial movement of the first bypass valve 1756, the first opening/closing portion 1756*b* is a portion that opens and closes the first bypass hole 1512*a*, and the first stopper 1756*c* is a portion that limits the axial movement of the first bypass valve 1756. Accordingly, the first bypass valve 1756 is configured as a piston valve. This is also applied to the second bypass valve 1757.

The first guide portion 1756*a* has a same cross-sectional shape as the first bypass valve guide hole 1722*a* in the axial direction. In other words, the first guide portion 1756*a* may be formed to have an arcuate cross-section and slides into the first bypass valve guide hole 1722*a*. Accordingly, the first bypass valve portion 1756 may be stably supported in the first bypass valve guide hole 1722*a* by the first guide portion 1756*a*.

The first opening/closing portion 1756*b* may be formed on one (first) end of the first guide portion 1756*a* and have a same cross-sectional shape as the first guide portion 1756*a*. In other words, the first opening/closing portion 1756*b* may be formed in an arcuate cross-sectional shape extending lengthwise along the first bypass hole 1512*a* from an end portion thereof facing the valve seating surface 1551 of the non-orbiting end plate 151. Accordingly, the first opening/closing portion 1756*b* may extend in a same shape from the first guide portion 1756*a*, which may facilitate formation of the first guide portion 1756*a* and the first opening/closing portion 1756*b*.

Although not illustrated in the drawings, the first opening/closing portion 1756*b* may be formed to have an area that is sufficient to open and close the first bypass hole 1512*a*, while the first guide portion 1756*a* may be formed to be thinner than the area of the first opening/closing portion 1756*b*. In this case, as described above, the length of the first bypass hole 1512*a* may be shortened to decrease an actual dead volume in the first bypass hole 1512*a* while a weight of the first guide portion 1756*a* may be reduced to enhance a valve response.

The first stopper 1756*c* may be formed on another (second) end of the first guide portion 1756*a* opposite to the first opening/closing portion 1756*b* with the valve guide 171 interposed therebetween. In other words, the first stopper 1756*c* may be formed at the another end of the first guide portion 1756*a* that faces the discharge guide groove 1611*c* of the back pressure plate 161.

The first stopper 1756*c* may be wider than the first guide portion 1756*a*. For example, the first stopper 1756*c* may extend in the lateral direction such that its cross-sectional area is wider than a cross-sectional area of the first bypass valve guide hole 1722*a*. Accordingly, the first stopper 1756*c* may be stopped by the valve guide 171 to suppress or prevent the first bypass valve 1756 from moving toward the non-orbiting scroll 150. Through this, the first bypass valve 1756 may be modularized together with the second bypass valve 1757 and the discharge valve 1751, to be coupled to the back pressure chamber assembly 160 by the valve guide 171.

The thickness of the first stopper 1756*c* may be substantially the same as the height of the guide separation protrusion 1732 in the axial direction. Accordingly, the first bypass valve 1756 may be sufficiently open without recessing the discharge guide groove 1611*c* excessively deep into the back pressure plate 161.

The second bypass valve 1757 may be symmetrical with the first bypass valve 1756 with respect to the discharge valve 1751. For example, the second bypass valve 1757 may include second guide portion 1757*a*, second opening/closing portion 1757*b*, and second stopper 1757*c*. The second guide portion 1757*a* is a portion that guides axial movement of the second bypass valve 1757, the second opening/closing portion 1757*b* is a portion that opens and closes the second bypass hole 1512*b*, and the second stopper 1757*c* is a portion that limits axial movement of the second bypass valve 1757. Accordingly, the second bypass valve 1757 may be configured as a piston valve, like the first bypass valve 1756. Therefore, repetitive description of the second bypass valve 1757 has been omitted.

In the drawings, unexplained reference numeral 1752 denotes an elastic member that supports the discharge valve.

The scroll compressor according to embodiments disclosed herein may operate as follows.

That is, when power is applied to the drive motor 120 and a rotational force is generated, the orbiting scroll 180 eccentrically coupled to the rotary shaft 125 performs an orbiting motion relative to the non-orbiting scroll 150 by an Oldham ring 180. At this time, a first compression chamber V1 and a second compression chamber V2 that continuously move are formed between the orbiting scroll 140 and the non-orbiting scroll 140. Then, the first compression chamber V1 and the second compression chamber V2 are gradually reduced in volume while moving from the suction port (or suction chamber) 1531 to the discharge port (or discharge chamber) 1511 during the orbiting motion of the orbiting scroll 140.

Refrigerant is suctioned into the low-pressure portion 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

Then, the refrigerant is compressed while moving along moving paths of the first compression chamber V1 and the second compression chamber V2. The compressed refrigerant partially flows into the back pressure chamber 160*a* formed by the back pressure plate 161 and the floating plate 165 through the first back pressure hole 1513 and the second back pressure hole 1611*b* before reaching the discharge port 1511. Accordingly, the back pressure chamber 160*a* forms an intermediate pressure.

Then, the floating plate 165 may rise toward the high/low pressure separation plate 115 to be brought into close contact with the sealing plate 1151 provided on the high/low pressure separation plate 115. Then, the high-pressure portion 110*b* of the casing 110 may be separated from the low-pressure portion 110*a*, to prevent the refrigerant discharged from each compression chamber V1 and V2 from flowing back into the low-pressure portion 110*a*.

On the other hand, the back pressure plate 161 is pressed down toward the non-orbiting scroll 150 by pressure of the back pressure chamber 160*a*. Then, the non-orbiting scroll 150 is pressed toward the orbiting scroll 140. Accordingly, the non-orbiting scroll 150 may be brought into close contact with the orbiting scroll 140, thereby preventing the refrigerant inside of the both compression chambers V1 and V2 from leaking from a high-pressure compression chamber forming an intermediate pressure chamber to a low-pressure compression chamber.

Then, the refrigerant is compressed to a set or predetermined pressure while moving from the intermediate pressure chamber toward a discharge pressure chamber. This refrigerant moves to the discharge port 1511 and presses the discharge valve 1751 in an opening direction. Responsive to this, the discharge valve 1751 is pushed up along the valve guide groove 1612*b* by pressure of the discharge pressure chamber, so as to open the discharge port 1511. The refrigerant in the discharge pressure chamber flows to the valve accommodating groove 155 through the discharge port 1511, and is discharged to the high-pressure portion 110*b* through the intermediate discharge port 1612*a* disposed in the back pressure plate 161.

The pressure of the refrigerant may rise above a preset or predetermined pressure due to various conditions that occur during operation of the compressor. The refrigerant moving from the intermediate pressure chamber to the discharge pressure chamber may be partially bypassed in advance from the intermediate pressure chambers forming the respective compression chambers V1 and V2 toward the high-pressure portion 110*b* through the first bypass hole 1512*a* and the second bypass hole 1512*b* before reaching the discharge pressure chamber.

For example, when the pressure in the first compression chamber V1 and the pressure in the second compression chamber V2 are higher than a set or predetermined pressure, the refrigerant compressed in the first compression chamber V1 moves to the first bypass hole 1512*a*, and the refrigerant in the second compression chamber V2 moves to the second bypass hole 1512*b*. Then, the refrigerant moving to these bypass holes 1512*a* and 1512*b* push up the first opening/closing portion 756*b* of the first bypass valve 1756 and the second opening/closing portion 1757*b* of the second bypass valve 1757 that close the first bypass hole 1512*a* and the second bypass hole 1512*b*. Then, the first opening/closing portion 1756*b* is pressed axially together with the first guide portion 1756*a* and the first stopper 1756*c*, and the second opening/closing portion 1757*b* is pressed axially together with the second guide portion 1757*a* and the second stopper 1757*c*, such that the first bypass hole 1512*a* and the second bypass hole 1512*b* are open. At this time, the first stopper 1756*c* of the first bypass valve 1756 and the second stopper 1757*c* of the second bypass valve 1757 are brought into contact with the discharge guide groove 1611*c* of the back pressure plate 161, thereby limiting a valve open degree.

The refrigerant in the first compression chamber V1 and the refrigerant in the second compression chamber V2 flow to the valve accommodating groove 155 through the first bypass hole 1512*a* and the second bypass hole 1512*b*, respectively. The refrigerant moves to the intermediate discharge port 1612*a* of the back pressure plate 161, together with the refrigerant discharged through the discharge port 1511, through the discharge guide passage 170*a*, which is the space between the valve guide 171 and the valve accommodating groove 155, and the discharge guide groove 1611*c*, and then flows into the high-pressure portion 110*b*. Accordingly, the refrigerant compressed in the compression chamber V may be suppressed or prevented from being overcompressed to a set or predetermined pressure or higher, thereby suppressing or preventing damage to the orbiting wrap 142 and/or the non-orbiting wrap 152 and improving compressor efficiency.

Thereafter, when overcompression of the compression chamber V is resolved and proper pressure is restored, the first bypass valve 1756 and the second bypass valve 1757 are pushed by the pressure of the high-pressure portion 110*b*. Then, the first bypass valve 1756 and the second bypass valve 1757 move toward the valve seating surface 1551 along the first bypass valve guide hole 1722*a* and the second bypass valve guide hole 1722*b*, respectively. Accordingly, the first opening/closing portion 1756*b* closes the first bypass hole 1512*a* and the second opening/closing portion 1757*b* closes the second bypass hole 1512*b*. This series of processes is repeatedly carried out.

At this time, high-pressure refrigerant that has not yet been discharged is trapped in the first bypass hole 1512*a* and the second bypass hole 1512*b*. Then, as the pressure in the compression chamber V rises unnecessarily, the first bypass hole 1512*a* and the second bypass hole 1512*b* form a kind of dead volume. Therefore, it is advantageous in view of decreasing the dead volume to reduce the lengths of the first bypass hole 1512*a* and the second bypass hole 1512*a* by forming the non-orbiting end plate 151 having the first bypass hole 1512*a* and the second bypass hole 1512*b* to be as thin as possible.

However, in the case in which the bypass valve 1755 is fastened to the non-orbiting end plate 151 as in the related art, the minimum fastening thickness for fastening the bypass valve 1755 is required, and this has a limitation in reducing the thickness of the non-orbiting end plate 151. As described above, in this embodiment, the discharge valve 1751 and the bypass valves 1755 may be configured as piston valves to slide into the valve guide 171 fastened to the back pressure plate 161. This structure may result in minimizing the thickness of the non-orbiting end plate 151 that is provided with the discharge port 1511 and the bypass holes 1512*a* and 1512*b*. Accordingly, the length of the discharge port 1511 and the lengths of the bypass holes 1512*a* and 1512*b* may be reduced, thereby minimizing the dead volume in the discharge port 1511 and the bypass holes 1512*a* and 1512*b*, and simultaneously minimizing an amount of refrigerant remaining in the discharge port 1511 and the bypass holes 1512*a* and 1512*b*. This may enhance compression efficiency.

Hereinafter, description will be given of a bypass valve according to another embodiment. That is, in the previous embodiment, the guide portion of the bypass valve is formed in a solid rod shape, but in some cases, the guide portion of the bypass valve may be formed in a hollow cylindrical shape.

Figure 8:
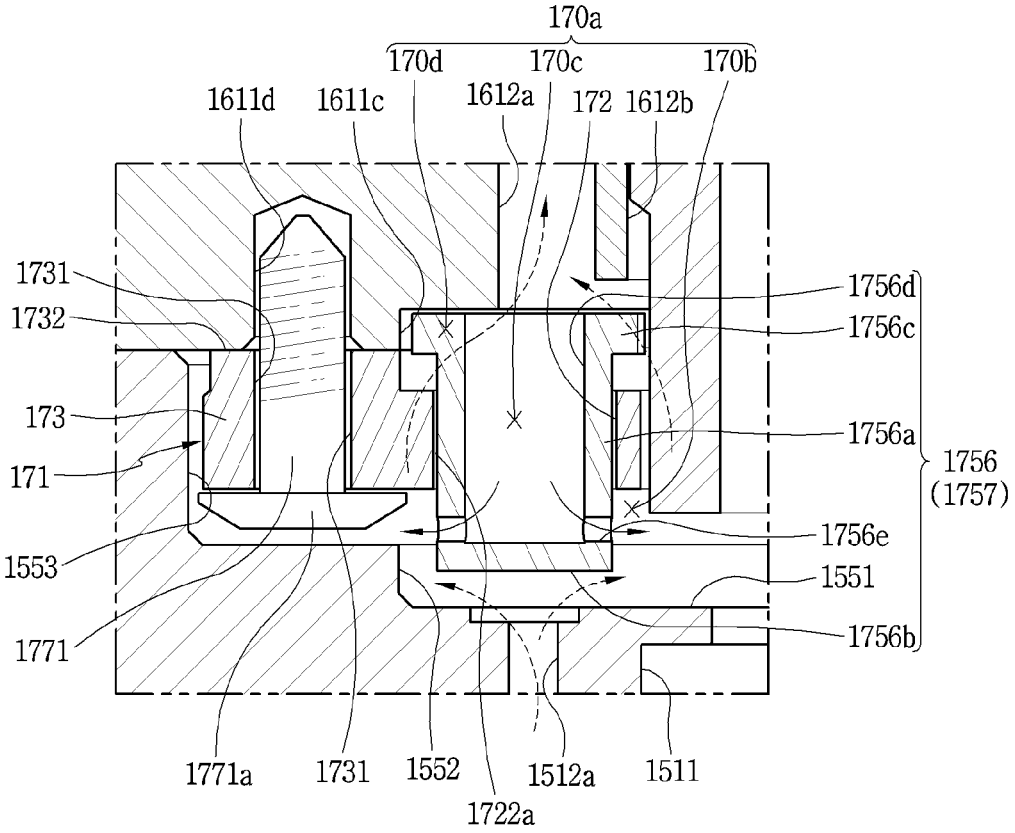
FIG. 8 is an assembled cross-sectional view of the bypass valve of FIG. 7.

FIG. 7 is a cutout perspective view of the bypass valve in FIG. 3 according to another embodiment. FIG. 8 is an assembled cross-sectional view of the bypass valve of FIG. 7.

Referring back to FIGS. 2 and 4, the scroll compressor according to this embodiment includes discharge port 1511 and bypass holes 1512*a* and 1512*b* formed in non-orbiting end plate 151, and the discharge port 1511 and the bypass holes 1512*a* and 1512*b* are formed inside of valve accommodating groove 155 recessed in rear surface 151*a* of the non-orbiting end plate 151. In addition, valve guide 171 constituting a portion of valve assembly 170 is fastened to back pressure plate 161 facing the rear surface 151*a* of the non-orbiting end plate 151, and discharge valve 1751 and bypass valves 1756 and 1757 that are configured as piston valves are slidably inserted axially into the valve guide 171, to open and close the discharge port 1511 and the bypass holes 1512*a* and 1512*b*. Accordingly, the length of the discharge port 1511 and the lengths of the bypass holes 1512*a* and 1512*b* may be shortened, so as to decrease the dead volumes in the discharge port 1511 and the bypass holes 1512*a* and 1512*b*. The basic configuration of the discharge valve 1751 and the bypass valves 1756 and 1757 and operating effects thereof may be the same as those of the previous embodiment.

However, in this embodiment, the bypass valves 1756 and 1757 may be formed in a hollow cylindrical shape. This may reduce the weight of the bypass valves 1756 and 1757 and increase responsiveness of the valves. As the first bypass valve 1756 and the second bypass valve 1757 are symmetrical with respect to each other with respect to the discharge valve 1751, hereinafter, the first bypass valve 1756 will be mainly described and repetitive description of the second bypass valve 1757 has been omitted.

Referring to FIGS. 7 and 8, the first bypass valve 1756 according to this embodiment may include first guide portion 1756*a*, first opening/closing portion 1756*b*, and first stopper 1756*c*. As the basic configuration of the first guide portion 1756*a*, the first opening/closing portion 1756*b*, and the first stopper 1756*c* is the same as that of the previous embodiment, repetitive description thereof has been omitted.

However, the first guide portion 1756*a* is formed in a hollow cylindrical shape. In other words, a first weight-reducing portion 1756*d* may be formed inside of the first guide portion 1756*a*. This may reduce a weight of the first guide portion 1756*a*, and accordingly, reduce an overall weight of the first bypass valve 1756, thereby improving valve response.

More specifically, the first weight-reducing portion 1756*d* may be recessed by a preset or predetermined depth from the first stopper 1756*c* toward the first opening/closing portion 1756*b*. In other words, while the first stopper 1756*c* is open, the first opening/closing portion 1756*b*, which substantially defines an opening/closing surface of the first bypass valve 1756, may be closed. As a result, an actual length of the first bypass hole 1512*a* may be shortened, so that the dead volume in the first bypass hole 1512*a* may decrease.

However, as in this embodiment, when the first weight-reducing portion 1756*d* is recessed into the first stopper 1756*c*, a first oil drainage hole 1756*e* may be formed in a penetrating manner from an inner circumferential surface of the first weight-reducing portion 1756*d* to an outer circumferential surface of the first guide portion 1756*a*. At least one first oil drainage hole 1756*e* may be provided, and may be disposed near a lower end of the first weight-reducing portion 1756*d*, namely, near the first opening/closing portion 1756*b*. Accordingly, even if oil flows into the first weight-reducing portion 1756*d*, the oil escapes to the outside of the first bypass valve 1756 through the first oil drainage hole 1756*e*. This may prevent the oil from stagnating in the first weight-reducing portion 1756*d*, which may result in suppressing or preventing an increase in weight of the first bypass valve 1756.

Although not illustrated in the drawings, the first weight-reducing portion 1756*d* may extend from the first opening/closing portion 1756*b* toward the first stopper 1756*c*. In other words, the first weight-reducing portion 1756*d* may be recessed from the first opening/closing portion 1756*b* to one side of the first stopper 1756*c*, and the first stopper 1756*c* may be closed. In this case, even if the first stopper 1756*c* is located at an upper side in the axial direction, it may suppress oil from flowing into the first weight-reducing portion 1756*d*.

Although not illustrated in the drawings, the first weight-reducing portion 1756*d* may be formed only inside of the first guide portion 1756*a*. In other words, the first weight-reducing portion 1756*d* may be located between the first opening/closing portion 1756*b* and the first stopper 1756*c*. In this case, the first opening/closing portion 1756*b* and/or the first stopper 1756*c* may be post-assembled with the first guide portion 1756*a*. Accordingly, introduction of oil into the first weight-reducing portion 1756*d* may be suppressed or prevented, and simultaneously the actual length of the first bypass hole 1512*a* may be shortened such that the dead volume in the first bypass hole 1512*a* may further decrease.

Although not illustrated in the drawings, the first weight-reducing portion 1756*d* may be formed laterally through the first guide portion 1756*a*. Even in this case, by reducing the weight of the first guide portion 1756*a*, the valve response may be improved while suppressing or preventing stagnation of oil in the first weight-reducing portion 1756*d*.

Although not illustrated in the drawings, the first guide portion 1756*a* may alternatively be formed in the shape with a plurality of thin rods. In this case, the first bypass valve guide hole 1722*a* may be formed as a plurality of small holes like the first guide portion 1756*a* or may be formed in a shape of a slit in which the plurality of guide portions 1756*a* is accommodated. Even in these cases, as an area of the first guide portion 1756*a* is reduced, the weight of the first bypass valve 1756 may be reduced, thereby improving the valve response.

Hereinafter, description will be given of a valve assembly according to another embodiment. That is, in the previous embodiment, the valve assembly is fastened to the back pressure chamber assembly, but in some cases, the valve assembly may be pressed and fixed between the non-orbiting scroll and the back pressure chamber assembly.

Figure 9:
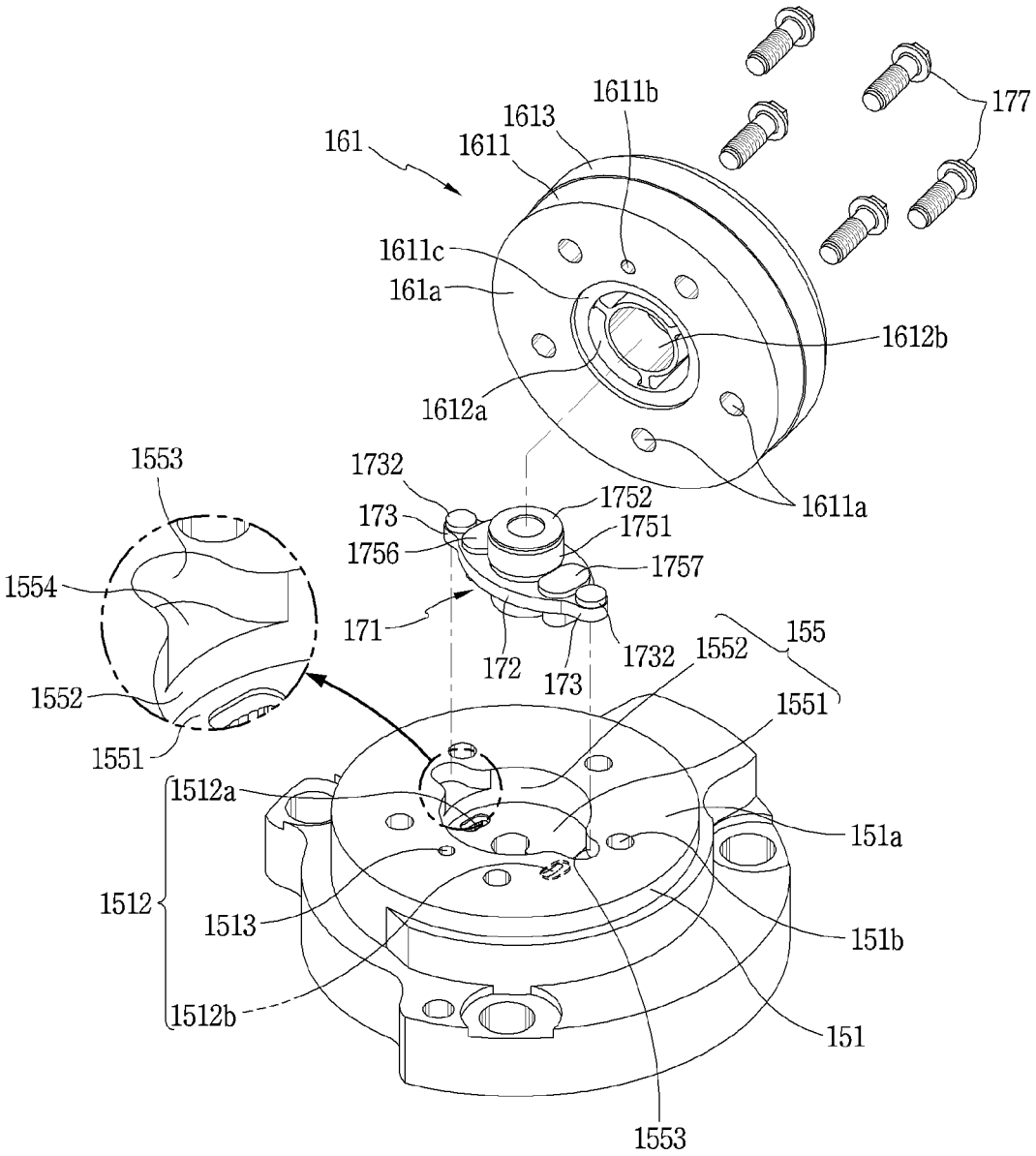
FIG. 9 is a perspective view of an assembly structure of a valve guide in FIG. 2 according to an embodiment.
Figure 10:
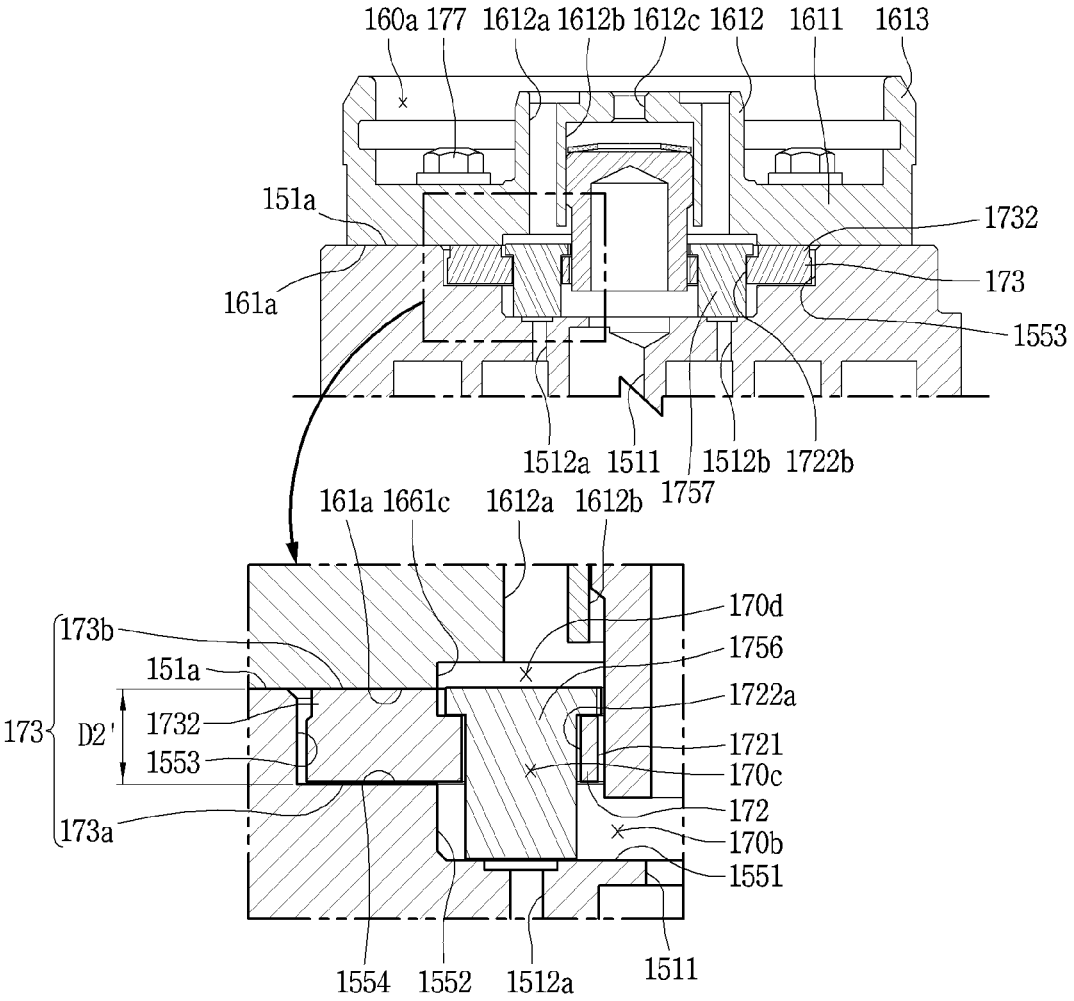
FIG. 10 is an assembled cross-sectional view of the valve guide of FIG. 9.

FIG. 9 is a perspective view of an assembly structure of a valve guide in FIG. 2 according to an embodiment. FIG. 10 is an assembled cross-sectional view of the valve guide of FIG. 9.

Referring to FIGS. 9 and 10, the scroll compressor according to this embodiment may include casing 110, drive motor 120, main frame 130, orbiting scroll 140, non-orbiting scroll 150, and back pressure chamber assembly 160. Valve assembly 170 may be disposed between the non-orbiting scroll 150 and the back pressure chamber assembly 160. The basic configuration of the non-orbiting scroll 150 and the back pressure chamber assembly 160 including the valve assembly 170 and their operating effects are similar to those of the previous embodiment.

For example, valve accommodating groove 155 may be recessed by a preset or predetermined depth into a central portion of rear surface 151*a* of non-orbiting end plate 151, and valve guide 171 constituting the valve assembly 170 may be inserted into the valve accommodating groove 155 to be fixed between the non-orbiting scroll 150 and the back pressure chamber assembly 160. Discharge valve 1751 and bypass valves 1755 may slide into the valve guide 171, so as to open and close discharge port 1511 and bypass holes 1512*a* and 1512*b* inside of the valve accommodating groove 155. Accordingly, the length of the discharge port 1511 and the lengths of the bypass holes 1512*a* and 1512*b* may be shortened, so as to decrease the dead volumes in the discharge port 1511 and the bypass holes 1512*a* and 1512*b*.

However, in this embodiment, the valve guide 171 is not fastened to the back pressure chamber assembly 160, but may be fixedly pressed between the non-orbiting scroll 150 and the back pressure chamber assembly 160 using a fastening force by which the back pressure chamber assembly 160 is fastened to the non-orbiting scroll 150. Accordingly, the valve assembly 170 may be firmly fixed between the non-orbiting scroll 150 and the back pressure chamber assembly 160 without using such separate fastening members 1771 and 1772 of the previous embodiments.

More specifically, a guide support surface 1554 that extends stepwise from valve seating surface 1551 may be formed on a bottom surface of the guide insertion groove 1553. In other words, the guide support surface 1554 may extend toward rear surface 161*a* of the back pressure plate 161 by a preset or predetermined height. Accordingly, the guide support surface 1554 defining the bottom surface of the guide insertion groove 1553 may protrude from the valve seating surface 1551 by a preset or predetermined height. Then, even if first axial side surface 173*a* of guide fixing protrusion 173 is brought into close contact with the guide support surface 1554, first discharge guide passage 170*b* may be defined between the first axial side surface 172*a* of the guide main body 172 and the valve seating surface 1551.

As described above, when the valve guide 171 is not fastened to the back pressure chamber assembly 160 but is fixed by the fastening force, by which the back pressure chamber assembly 160 is fastened to the non-orbiting scroll 150, an assembly process may be simplified and manufacturing costs may be reduced without the use of separate fastening members.

Although not illustrated in the drawings, a guide separation protrusion (not illustrated) may extend from the first axial side surface 173*a* of the guide fixing protrusion 173 to protrude toward the bottom surface of the guide insertion groove 1553 by a preset or predetermined height, or the guide support surface and the guide separation protrusion described above may be formed, respectively. Even in these cases, the valve guide 171 may be fixed between the non-orbiting scroll 150 and the back pressure chamber assembly 160 without being fastened to the back pressure chamber assembly 160.

Hereinafter, description will be given of a valve assembly according to still another embodiment. That is, in the previous embodiments, the valve assembly is fastened to the back pressure chamber assembly, but in some cases, the valve assembly may be fastened to the non-orbiting scroll.

Figure 11:
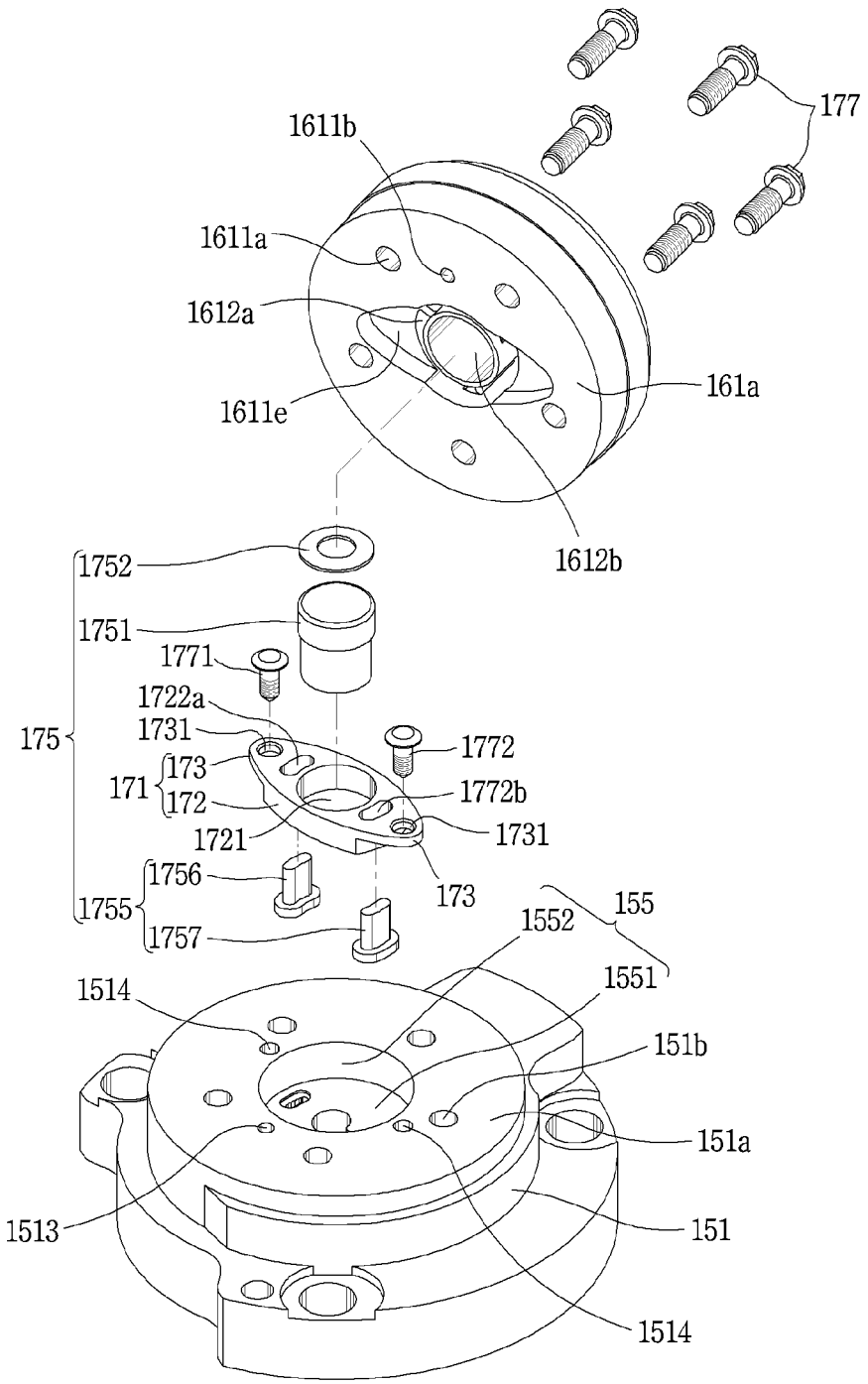
FIG. 11 is an exploded perspective view of a valve assembly in FIG. 1 according to another embodiment.
Figure 12:
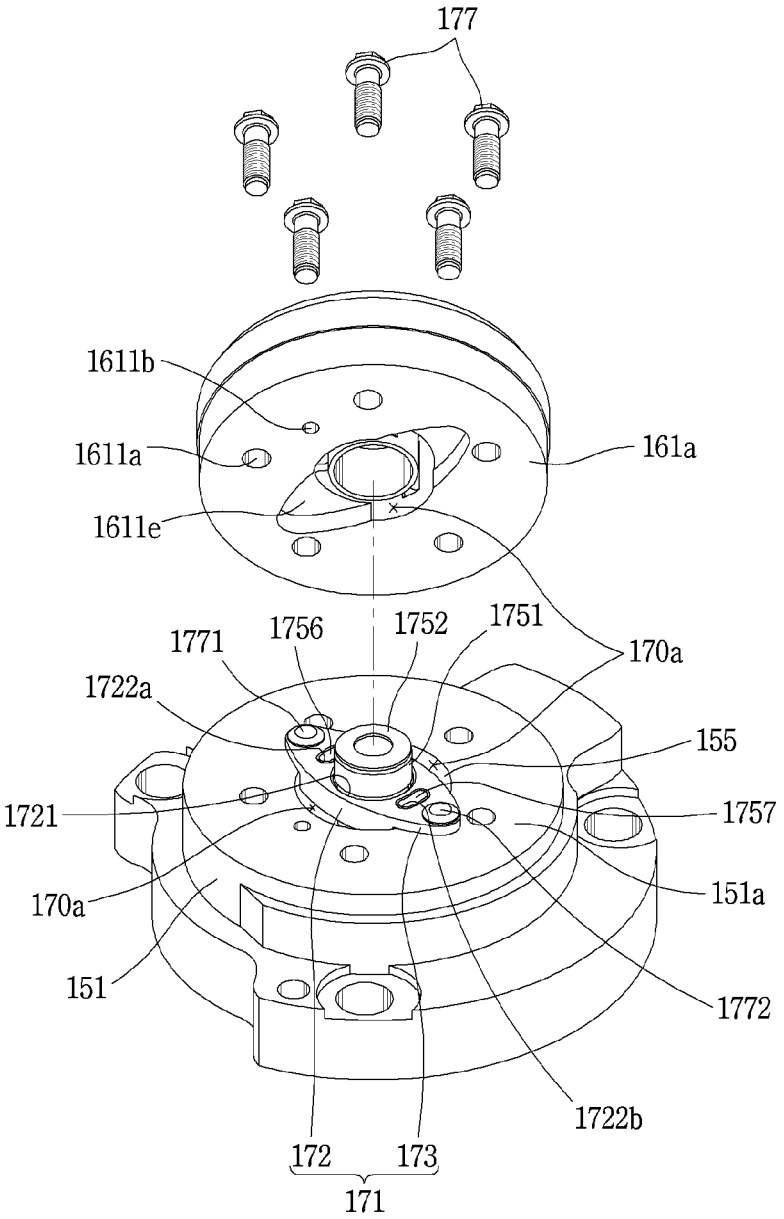
FIG. 12 is a perspective view illustrating the valve assembly assembled with the non-orbiting scroll in FIG. 11.
Figure 13:
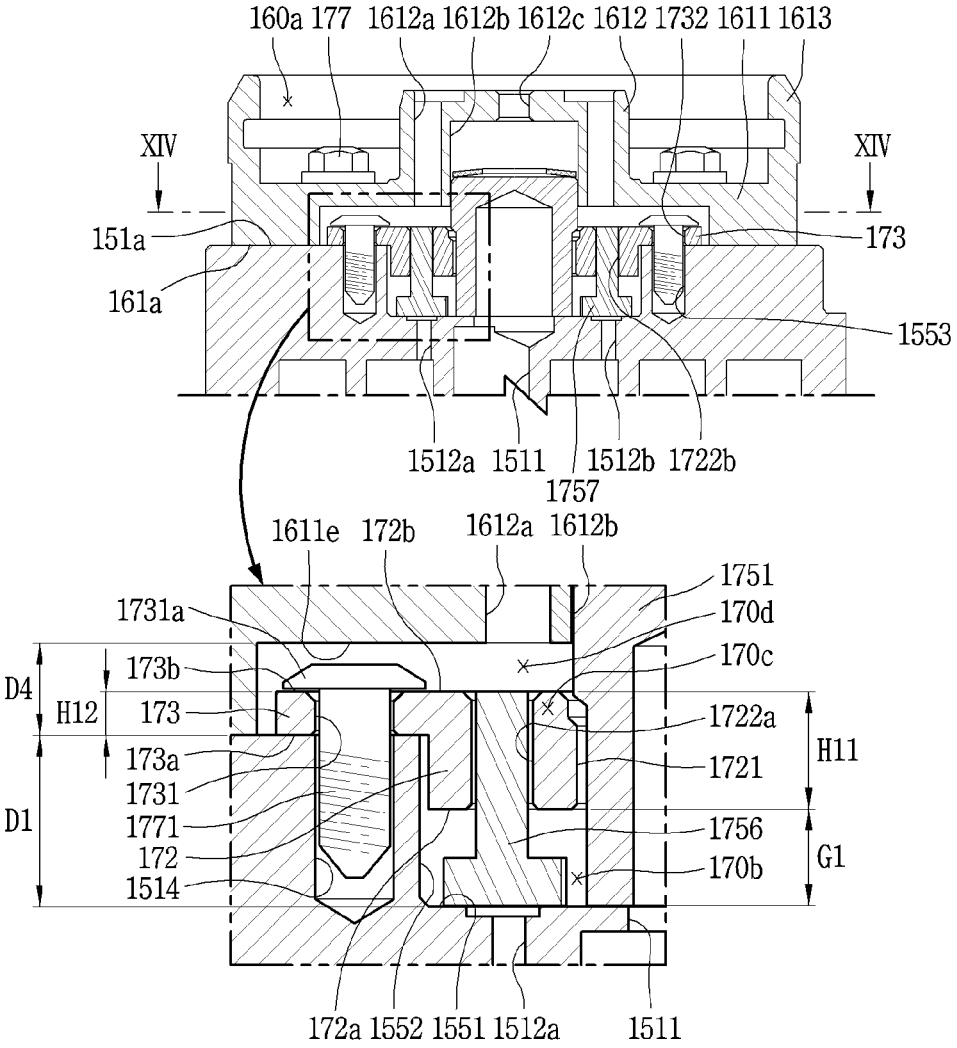
FIG. 13 is a cross-sectional view illustrating a state in which the back pressure chamber assembly is assembled with the non-orbiting scroll in FIG. 12.
Figure 14:
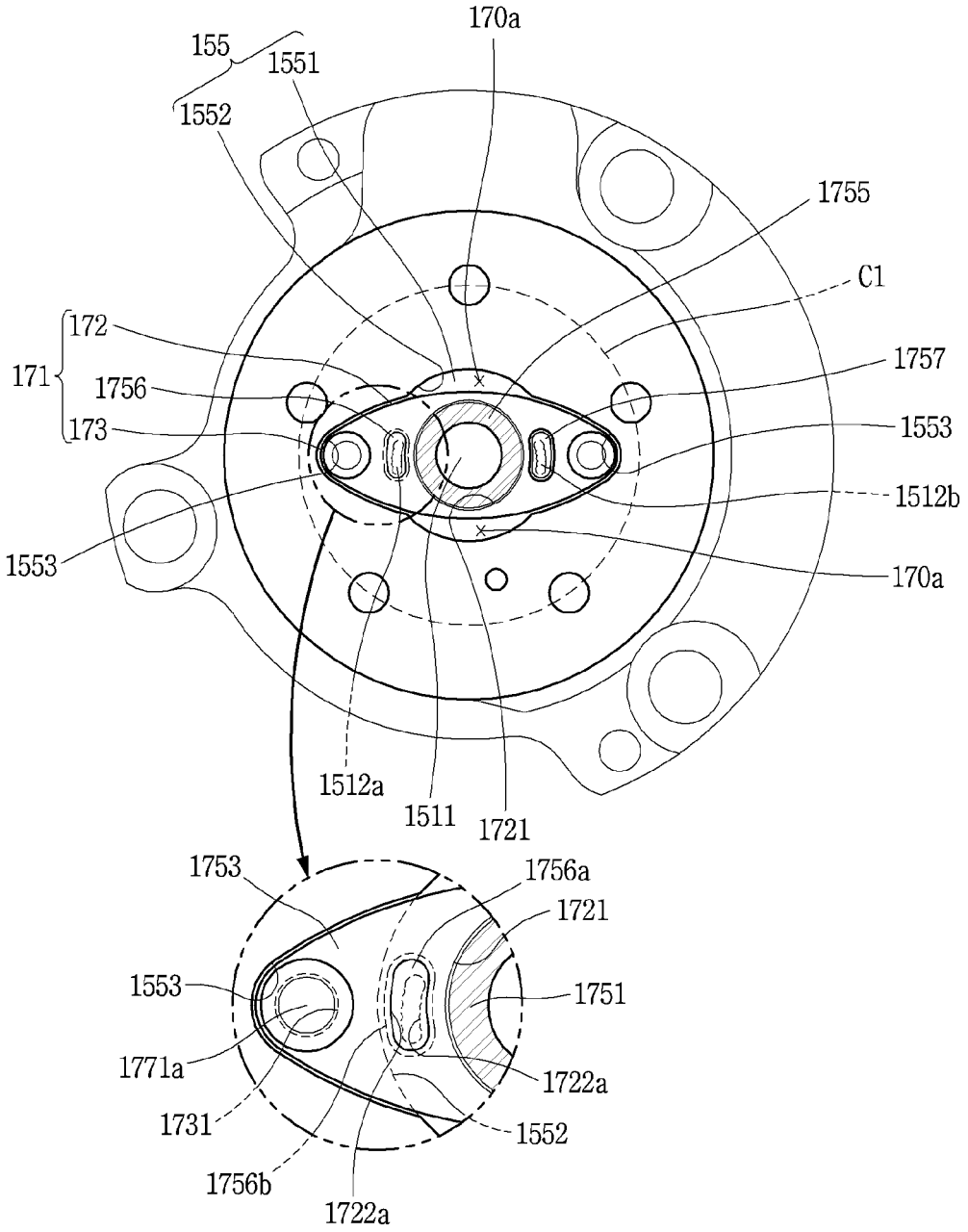
FIG. 14 is a cross-sectional view, taken along line "XIV-XIV" of FIG. 13.
Figure 15:
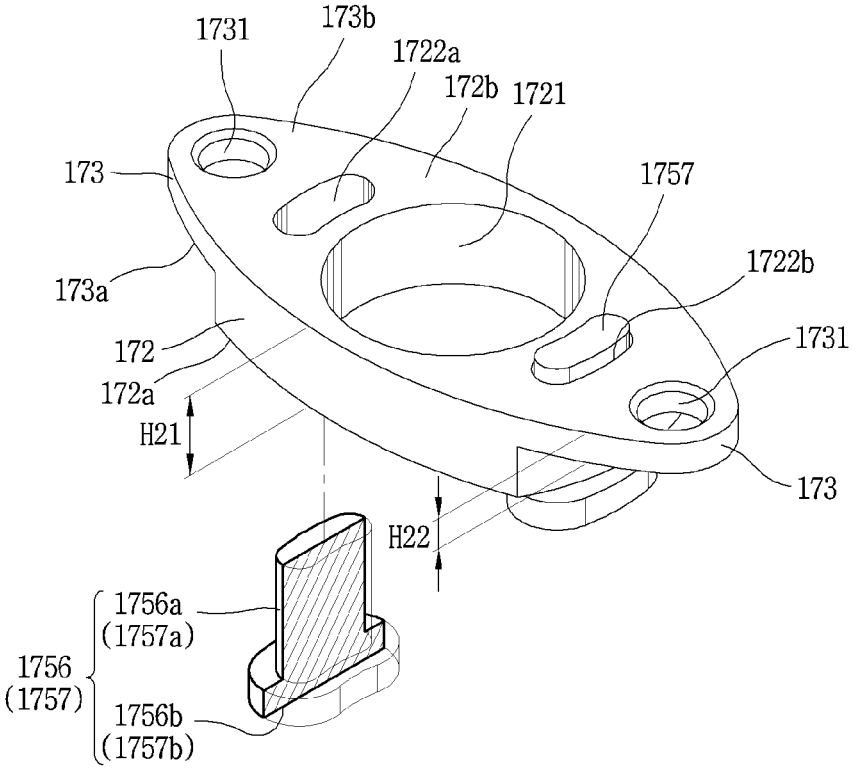
FIG. 15 is an enlarged perspective view illustrating a valve guide and a bypass valve in FIG. 12.

FIG. 11 is an exploded perspective view another of a valve assembly in FIG. 1 according to another embodiment. FIG. 12 is a perspective view illustrating the valve assembly assembled with the non-orbiting scroll in FIG. 11. FIG. 13 is a cross-sectional view illustrating a state in which the back pressure chamber assembly is assembled with the non-orbiting scroll in FIG. 12. FIG. 14 is a cross-sectional view, taken along line "XIV-XIV" of FIG. 13. FIG. 15 is an enlarged perspective view illustrating a valve guide and a bypass valve in FIG. 12.

Referring back to FIG. 1, the scroll compressor according to this embodiment may include casing 110, drive motor 120, main frame 130, orbiting scroll 140, non-orbiting scroll 150, and back pressure chamber assembly 160. Valve assembly 170 may be disposed between the non-orbiting scroll 150 and the back pressure chamber assembly 160. The basic configuration of the non-orbiting scroll 150 and the back pressure chamber assembly 160 including the valve assembly 170 and their operating effects are similar to those of the previous embodiment.

For example, valve accommodating groove 155 may be recessed by a preset or predetermined depth into a central portion of rear surface 151*a* of non-orbiting end plate 151, and valve guide 171 constituting the valve assembly 170 may be inserted into the valve accommodating groove 155 to be fixed between the non-orbiting scroll 150 and the back pressure chamber assembly 160. Discharge valve 1751 and bypass valves 1755 may slide into the valve guide 171, so as to open and close discharge port 1511 and bypass holes 1512*a* and 1512*b* inside of the valve accommodating groove 155. Accordingly, the length of the discharge port 1511 and the lengths of the bypass holes 1512*a* and 1512*b* may be shortened, so as to decrease the dead volumes in the discharge port 1511 and the bypass holes 1512*a* and 1512*b*.

However, in this embodiment, the valve guide 171 constituting the valve assembly 170 may be fastened to the rear surface of the non-orbiting scroll 150, namely, rear surface 151*a* of non-orbiting end plate 151. For example, the valve guide 171 may be fastened to the rear surface 151*a* of the non-orbiting end plate 151 with a portion thereof exposed to the outside of the valve accommodating groove 155.

Referring to FIGS. 11 and 12, the valve accommodating groove 155 is formed in the center of the rear surface 151*a* of the non-orbiting end plate 151 according to this embodiment, and a plurality of guide fastening grooves 1514 is formed outside of the valve accommodating groove 155. The guide fastening grooves 1514 are formed on a same axis as the guide fastening holes 1731 provided in the guide fixing protrusions 173 at positions spaced apart from the valve accommodating groove 155 by a preset or predetermined distance. Accordingly, the valve guide 171 may be fastened to the non-orbiting scroll 150 by fastening members 1771 and 1772 that are fastened to the guide fastening grooves 1514 through the guide fastening holes 1731.

In other words, the valve guide 171 according to this embodiment may include guide main body 172 and guide fixing protrusions 173. With this structure, the guide main body 172 that includes discharge valve guide hole 1721 and bypass valve guide holes 1722 may be accommodated in the valve accommodating groove 155, while the guide fixing protrusions 173 that include guide fastening holes 1731, respectively, and extend laterally from both ends of the guide main body 172, as described above, may be fastened to the rear surface 151*a* of the non-orbiting end plate 151 while being exposed to the outside of the valve accommodating groove 155.

In this case, as illustrated in FIGS. 13 and 15, a thickness H21 of the guide main body 172 is smaller than a height of the guide accommodating surface 1552, that is, thinner than a depth D1 of the valve accommodating groove 155. Accordingly, the first discharge guide passage 170*b* described above is defined between the first axial side surface 172*a* of the guide main body 172 and the valve seating surface 1551 facing the same.

However, when the thickness H21 of the guide main body 172 is too thin, opening and closing lengths of the bypass valves 1755 described hereinafter may be excessively elongated, which may cause a closing operation to be delayed. Accordingly, the thickness H21 of the guide main body 172 may be larger than or equal to a gap G1 between the valve seating surface 1551 and the first axial side surface 172*a* of the guide main body 172 facing the valve seating surface 1551. Through this, the bypass valves 1755 may be quickly closed while securing the first discharge guide passage 170*b*, thereby suppressing a reverse flow of refrigerant through the bypass holes 1512*a* and 1512*b*.

In addition, a cross-sectional area of the guide main body 172 may be smaller than a cross-sectional area of the valve accommodating groove 155, that is, the guide main body 172 may be formed in an elliptical shape having a minor axial length that is shorter than an inner diameter of the valve accommodating groove 155. Accordingly, second discharge guide passage 170*c* that connects first discharge guide passage 170*b* and intermediate discharge port 1612*a* may be defined between the outer circumferential surface of the guide main body 172 and the inner circumferential surface of the valve accommodating groove 155.

A guide accommodating groove 1611*e* that accommodates an upper half of the valve guide 171, that is, the guide main body 172 and the guide fixing protrusions 173 extending from the guide main body 172 may be recessed axially by a preset or predetermined depth into the rear surface 161*a* of the back pressure plate 161 that faces the second axial side surface 171*b* of the valve guide 171. Accordingly, the valve guide 171 exposed to the outside of the valve accommodating groove 155 may be accommodated in the guide accommodating groove 1611*e* of the back pressure chamber assembly 160. Through this, in a state in which the valve assembly 170 is disposed between the rear surface 151*a* of the non-orbiting scroll 150 and the rear surface 161*a* of the back pressure chamber assembly 160 facing the rear surface 151*a*, they may all be fastened in a close contact.

In addition, the intermediate discharge port 1612*a* may be disposed inside of the guide accommodating groove 1611*e*, and the valve guide groove 1612*b* that accommodates the discharge valve 1751 may be disposed inside of the intermediate discharge port 1612*a*. In this case, a lower end of the valve guide groove 1612*b* overlaps the guide accommodating groove 1611*e* in the radial direction. Accordingly, the valve guide groove 1612*b* may be elongated, to stably support a reciprocating motion of the discharge valve 1751 described hereinafter. In addition, the length of the discharge valve 1751 may be reduced as short as possible, the weight of the discharge valve 1751 may be reduced, and valve response may be improved accordingly.

In addition, the guide accommodating groove 1611*e* may be formed in the same shape as the outer circumferential surface of the valve guide 171, that is, in an elliptical shape. However, a cross-sectional area of the guide accommodating groove 1611*e* may be larger than a cross-sectional area of the valve guide 171, and a depth D2' of the guide accommodating groove 1611*e* may be formed deeper than thickness H22 of the guide fixing protrusion 173. Accordingly, still another portion of the discharge guide passage 170*a*, namely, a third discharge guide passage 170*d* may be defined between the guide accommodating groove 1611*e* and the valve guide 171 to be continuous with the second discharge guide passage 170*c*. Through this, refrigerant that is discharged through the discharge port 1511 and the bypass holes continuously passes through the first, second, and third discharge guide passages 170*b*, 170*c*, and 170*d*, and then is discharged to the high-pressure portion 110*b* of the casing 110 through the intermediate discharge port 1612*a*.

The valve guide 171, as described above, may include discharge valve guide hole 1721 and first and second bypass valve guide holes 1722*a* and 1722*b*. The discharge valve guide hole 1721 may be formed in the center of the valve guide 171, and the first and second bypass valve guide holes 1722*a* and 1722*b* may be formed at both sides of the discharge valve guide hole 1721, respectively. As the basic shapes of the discharge valve guide hole 1721 and the first and second bypass valve guide holes 1722*a* and 1722*b* and operating effects thereof are the same as those of the previous embodiment, repetitive description thereof has been omitted. These are also similarly applied to the discharge valve 1751.

However, in the bypass valve 1755 according to this embodiment, unlike the previous embodiment, opening/closing portion 1756*b*, 1757*b* may be formed wider than bypass valve guide hole 1722*a*, 1722*b*, so as to serve as a stopper that limits an open degree of the bypass valve 1755. As the first bypass valve 1756 and the second bypass valve 1757 are symmetrical with each other with respect to the discharge valve 1751, hereinafter, the first bypass valve 1756 will be mainly described and repetitive description of the second bypass valve 1757 has been omitted.

Referring to FIGS. 13 to 15, the first bypass valve 1756 according to this embodiment may include first guide portion 1756*a* and first opening/closing portion 1756*b*. The first guide portion 1756*a* may also be formed in an arcuate cross-sectional shape as in the previous embodiment, but may be formed in a solid rod shape. Accordingly, the length of the first bypass hole 1512*a* may be shortened, and manufacturing of the first guide portion 1756*a* may be facilitated.

The first guide portion 1756*a* may have an arcuate cross-sectional shape and may be smaller than the first bypass hole 1512*a*. For example, the cross-sectional area (arcuate length) of the first guide portion 1756*a* may be significantly smaller than a cross-sectional area (arcuate length) of the first bypass hole 1512*a*. Accordingly, a weight of the first guide portion 1756*a* may be reduced while the first guide portion 1756*a* is formed in the solid rod shape.

The first opening/closing portion 1756*b* may define a lower end in the axial direction of both ends of the first guide portion 1756*a* and may extend laterally from an end portion of the first guide portion 1756*a* facing the first bypass hole 1512*a*. For example, the cross-sectional area of the first opening/closing portion 1756*b* may be larger than the cross-sectional area of the bypass valve guide hole 1722*a* as well as the cross-sectional area of the first bypass hole 1512*a*. Accordingly, the bypass valve 1755 may be prevented from be separated from the valve guide 171 as the first opening/closing portion 1756*b* is caught on the first axial side surface 172*a* of the guide main body 172 during assembly and/or an opening operation. This may modularize the valve assembly 170 including the bypass valves 1755, thereby facilitating assembly of the valve assembly 170. In addition, an open degree of the bypass valves 1755 may be appropriately limited so as to enhance the valve response, and reverse flow of refrigerant through the first bypass hole 1512*a* may be suppressed or prevented although the piston valve is applied, thereby enhancing compression efficiency.

Figure 16:
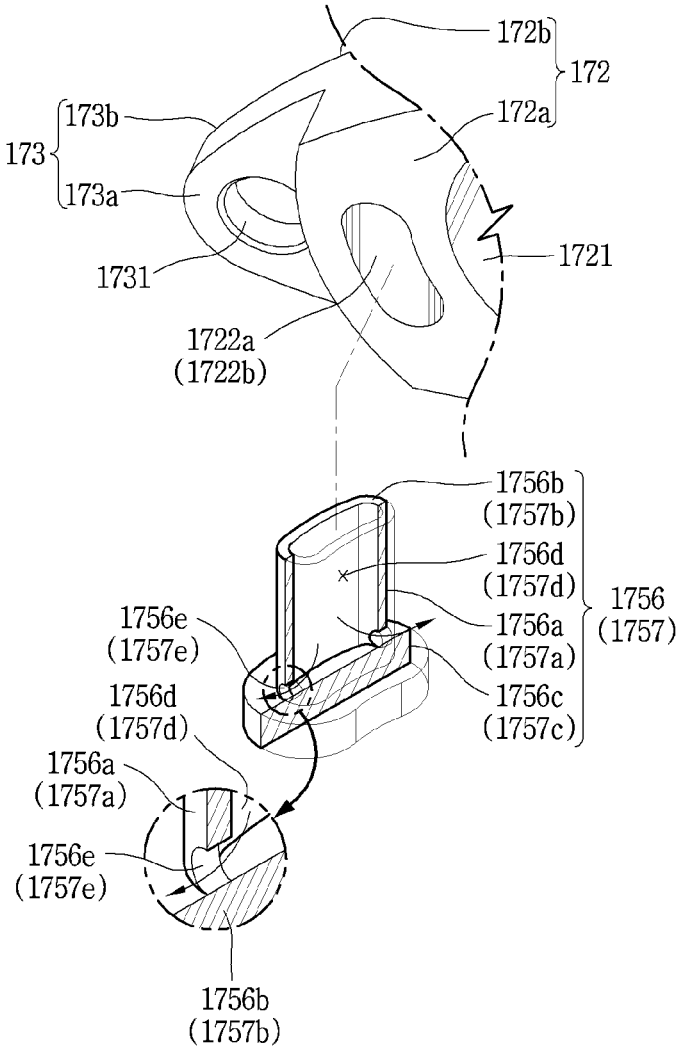
FIGS. 16 and 17 are cutout perspective views of the bypass valve according to another embodiment.
Figure 17:
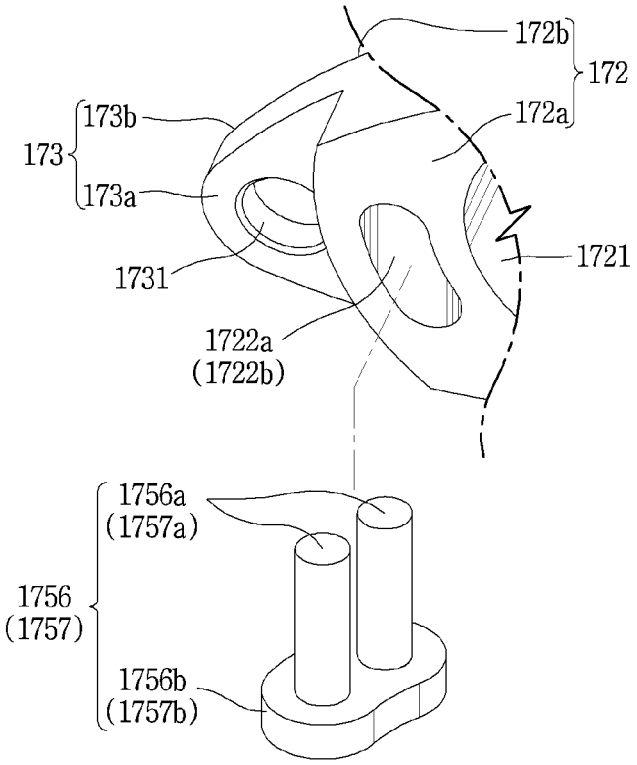

In the first bypass valve 1756, the first weight-reducing portion 1756*d* may be formed inside of the first guide portion 1756*a*, or the first guide portion 1756*a* may include a plurality of rods. In these cases, as the cross-sectional area of the first guide portion 1756*a* may be reduced and the weight thereof may be reduced accordingly. This may result in decreasing the weight of the valve. FIGS. 16 and 17 are perspective views according to other embodiments of a bypass valve.

Referring to FIG. 16, the first guide portion 1756*a* may be formed in a hollow cylindrical shape. For example, the first weight-reducing portion 1756*d* may be formed inside of the first guide portion 1756*a*. Even in this case, the first weight-reducing portion 1756*d* may be formed only inside of the first guide portion 1756*a* with both ends of the first guide portion 1756*a* closed, may be recessed from the first opening/closing portion 1756*b* toward an opposite end portion (top) of the first guide portion 1756*a*, or may be recessed by a preset or predetermined depth from one end (top) of the first guide portion 1756*a* toward the first opening/closing portion 1756*b*. This embodiment illustrates an example in which the first weight-reducing portion 1756*d* is recessed from the one end (top) of the first guide portion 1756*a* toward the first opening/closing portion 1756*b* by the preset depth.

In this case, a first oil drainage hole 1756*e* may be formed in a penetrating manner from the inner circumferential surface of the first weight-reducing portion 1756*d* to the outer circumferential surface of the first guide portion 1756*a*. Accordingly, even if oil flows into the first weight-reducing portion 1756*d*, the oil may quickly flow out through the first oil drainage hole 1756*e*, thereby suppressing or preventing the oil from stagnating in the first weight-reducing portion 1756*d*.

Referring to FIG. 17, the first guide portion 1756*a* may be provided as a plurality each formed in a rod shape. For example, the first guide portion 1756*a* may include two rods, each of which has a shape with a circular cross-section. Accordingly, while the first guide portion 1756*a* may be provided as a plurality, an overall cross-sectional area of the first guide portions 1756*a* may be minimized, thereby reducing a weight thereof.

In addition, the first guide portion 1756*a* may be configured as two rods, which may extend from both ends of the first opening/closing portion 1756*b* in the axial direction. Accordingly, the first guide portion 1756*a* may be reduced in thickness while stably supporting the first opening/closing portion 1756*b*.

As described above, when the first guide portion 1756*a* is configured as two rods, the number of bypass valve guide holes 1722*a* into which the first guide portions 1756*a* are slidably inserted may be provided as a plurality or may be provided as one in number. For example, the bypass valve guide holes 1722*a* may be provided to correspond to the number of first guide portions 1756*a*, or may be provided as a single piece such that the plurality of first guide portions 1756*a* may all be inserted. This embodiment illustrates an example in which a single bypass valve guide hole 1722*a* is provided. In this case, the bypass valve guide hole 1722*a* is formed in a shape with an arcuate cross-section, so that the first guide portions 1756*a* may be slidably inserted into both ends of the bypass valve guide hole 1722*a*, respectively. Accordingly, as the first guide portion 1756*a* is configured as the plurality of rods, the weight of the first guide portion 1756*a* may be reduced and the bypass valve guide hole 1722*a* may be easily formed.

Hereinafter, description will be given of a valve assembly according to still another embodiment. That is, in the previous embodiment, the valve assembly is fastened to the non-orbiting scroll, but in some cases, the valve assembly may be pressed and fixed between the non-orbiting scroll and the back pressure chamber assembly.

Figure 18:
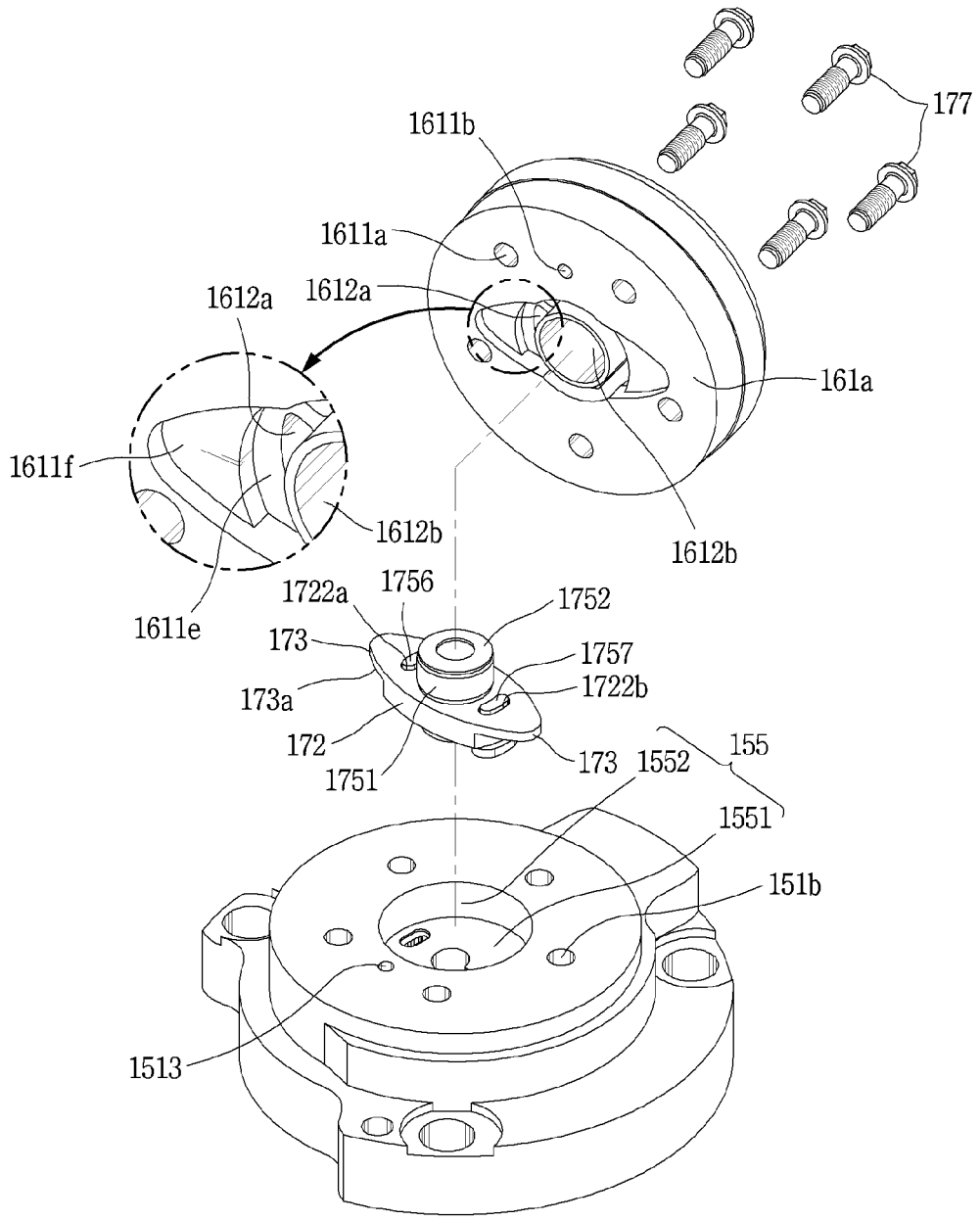
FIG. 18 is a perspective view of an assembly structure of a valve guide in FIG. 11 according to an embodiment.
Figure 19:
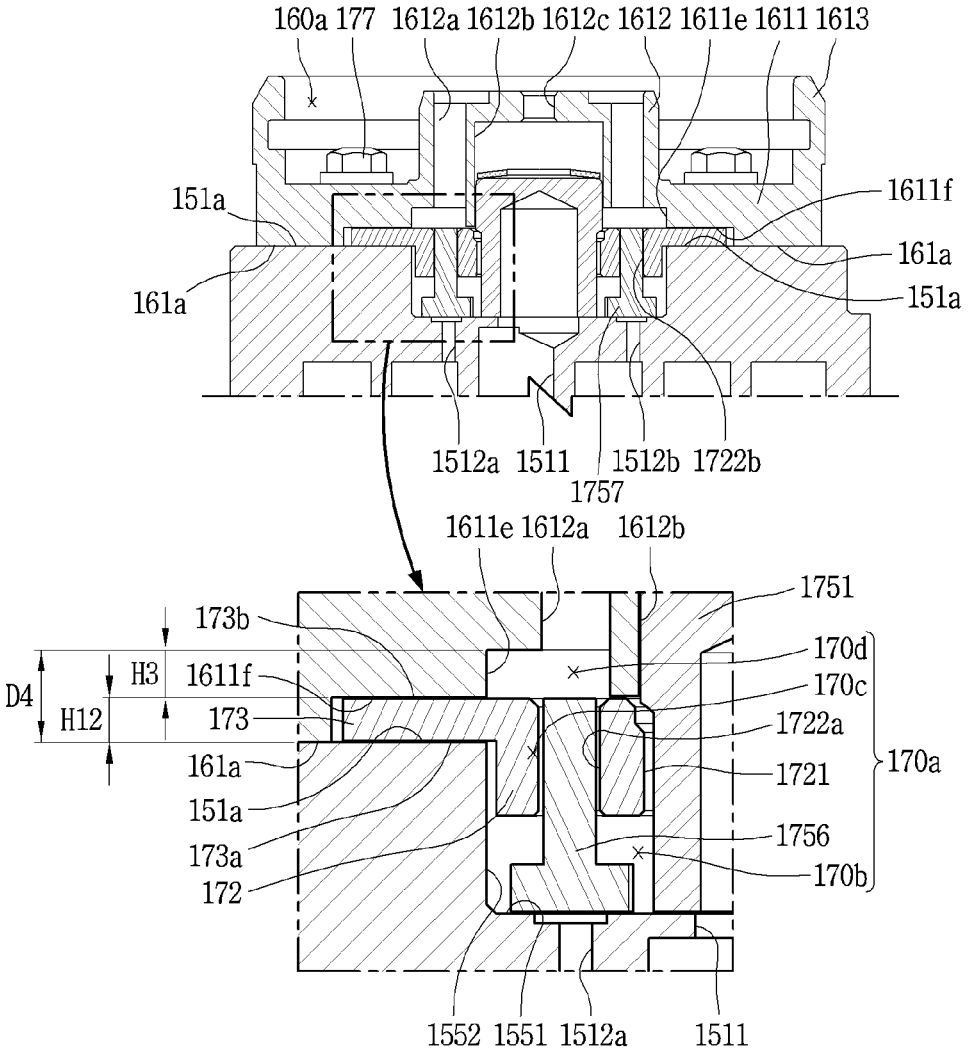
FIG. 19 is an assembled cross-sectional view of the valve guide of FIG. 18.

FIG. 18 is a perspective view of an assembly structure of a valve guide in FIG. 11 according to an amendment. FIG. 19 is an assembled cross-sectional view of the valve guide of FIG. 18.

Referring back to FIG. 1, the scroll compressor according to this embodiment may include casing 110, drive motor 120, main frame 130, orbiting scroll 140, non-orbiting scroll 150, and back pressure chamber assembly 160. Valve assembly 170 may be disposed between the non-orbiting scroll 150 and the back pressure chamber assembly 160. The basic configuration of the non-orbiting scroll 150 and the back pressure chamber assembly 160 including the valve assembly 170 and their operating effects are similar to those of the previous embodiment.

For example, valve accommodating groove 155 may be recessed by a preset or predetermined depth into a central portion of rear surface 151*a* of non-orbiting end plate 151, and valve guide 171 constituting the valve assembly 170 may be inserted into the valve accommodating groove 155 to be fixed between the non-orbiting scroll 150 and the back pressure chamber assembly 160. Discharge valve 1751 and bypass valves 1755 may slide into the valve guide 171, so as to open and close discharge port 1511 and bypass holes 1512*a* and 1512*b* inside of the valve accommodating groove 155. Accordingly, the length of the discharge port 1511 and the lengths of the bypass holes 1512*a* and 1512*b* may be shortened, so as to decrease the dead volumes in the discharge port 1511 and the bypass holes 1512*a* and 1512*b*.

However, in this embodiment, the valve guide 171 is not fastened to the non-orbiting scroll 150, but may be fixedly pressed between the non-orbiting scroll 150 and the back pressure chamber assembly 160 using a fastening force by which the back pressure chamber assembly 160 is fastened to the non-orbiting scroll 150. Accordingly, the valve assembly 170 may be firmly fixed between the non-orbiting scroll 150 and the back pressure chamber assembly 160 without using separate fastening members.

Referring to FIGS. 18 and 19, guide fixing protrusions 173 of the valve guide 171 may be inserted into guide accommodating groove 1611*e* of the back pressure plate 161. First axial side surfaces 173*a* of the guide fixing protrusions 173 may be brought into close contact with the rear surface 151*a* of the non-orbiting end plate 151 while second axial side surfaces 173*b* of the guide fixing protrusions 173 may be fixed in close contact to rear surface 161*a* of the back pressure plate 161 inside of the guide accommodating groove 1611*e*.

In this case, depth D4 of the guide accommodating groove 1611*e* may be deeper than a thickness of the valve guide 171, namely, thickness H22 of the guide fixing protrusion 173, thereby defining third discharge guide passage 170*d* as illustrated in the previous embodiment. However, a guide support surface 1611*f* may be disposed between the guide fixing protrusion 173 and the guide accommodating groove 1611*e* facing the guide fixing protrusion 173.

For example, the guide support surface 1611*f* may protrude from a bottom surface of the guide accommodating groove 1611*e* toward the second axial side surface 173*b* of the guide fixing protrusion 173 by a preset or predetermined height. In this case, height H4 of the guide support surface 1611*f* may be a value obtained by subtracting the thickness H22 of the guide fixing protrusion 173 from the depth D4 of the guide accommodating groove 1611*e*. Accordingly, the first axial side surface 173*a* of the guide fixing protrusion 173 may be brought into close contact with the rear surface 151*a* of the non-orbiting end plate 151, while the second axial side surface 173*b* of the guide fixing protrusion 173 may be brought into close contact with the guide support surface 1611*f*.

Then, the guide fixing protrusion 173 which is in an inserted state in the guide accommodating groove 1611*e* is fixed by the rear surface 151*a* of the non-orbiting end plate 151 and the bottom surface of the guide accommodating groove 1611*e*. With this configuration, as the valve guide 171 is not fastened to the non-orbiting scroll 150 but is fixed by the fastening force, by which the back pressure chamber assembly 150 is fastened to the non-orbiting scroll 150, an assembly process for the valve assembly 170 may be simplified and manufacturing costs thereof may be reduced without the use of separate fastening members.

Although not illustrated, a guide support surface (not illustrated) may extend from the guide fixing protrusion 173 toward the guide accommodating surface 1611*e*, or may extend half from the guide fixing protrusion 173 and another half from the guide accommodating surface 1611*e* toward each other. Even in these cases, as fastening members may be excluded, the assembly process for the valve assembly 170 may be simplified.

On the other hand, as described above, embodiments of the valve assembly may be equally applied to an open type as well as a hermetic type, to a high-pressure type as well as a low-pressure type, and even to a horizontal type as well as a vertical type. The embodiments disclosed herein may also be equally applied to an orbiting back pressure type or a tip seal type as well as the non-orbiting back pressure type. In particular, in the orbiting back pressure type or the tip seal type, a separate plate, instead of the back pressure chamber assembly, may be fixed to the rear surface of the non-orbiting scroll (fixed scroll), and the valve assembly of the previous embodiments may be fixed using the plate. Even in this embodiment, the basic configuration of the valve assembly or operational effect thereof may be substantially the same as those of the previous embodiments.

Embodiments disclosed herein provide a scroll compressor capable of suppressing or preventing overcompression and decreasing a dead volume in a compression chamber. Embodiments disclosed herein also provide a scroll compressor capable of reducing a length of a bypass hole, and thus, decreasing a dead volume in the bypass hole.

Embodiments disclosed herein further provide a scroll compressor capable of stably fixing a bypass valve while reducing a length of a bypass hole. Embodiments disclosed herein furthermore provide a scroll compressor capable of decreasing a dead volume in a discharge port.

Embodiments disclosed herein provide a scroll compressor capable of reducing a length in a discharge port so as to decrease a dead volume in the discharge port. Embodiments disclosed herein also provide a scroll compressor capable of enhancing compression efficiency by quickly discharging refrigerant that passes through a discharge port.

Embodiments disclosed herein provide a scroll compressor capable of facilitating installation of a bypass valve and a discharge valve. Embodiments disclosed herein additionally provide a scroll compressor that is capable of modularizing a bypass valve and a discharge valve to enhance assembly property and assembly reliability for the bypass valve and the discharge valve. Embodiments disclosed herein further provide a scroll compressor capable of quickly discharging refrigerant that passes through a bypass hole and a discharge port while modularizing a bypass valve and a discharge valve.

Embodiments provide disclosed provide a scroll compressor that may include a casing, a rotary shaft, an orbiting scroll, a non-orbiting scroll, and a back pressure chamber assembly. The orbiting scroll may perform an orbiting motion by being coupled to the rotary shaft in an inner space of the casing. The non-orbiting scroll may be engaged with the orbiting scroll to define compression chambers, and may include a discharge port and bypass holes through which refrigerant in the compression chambers are discharged. The back pressure chamber assembly may be coupled to a rear surface of the non-orbiting scroll to press the non-orbiting scroll toward the orbiting scroll. A valve accommodating groove may be recessed into the rear surface of the non-orbiting scroll by a preset or predetermined depth to accommodate the discharge port and the bypass holes therein. A valve guide may be disposed between the rear surface of the non-orbiting scroll and a rear surface of the back pressure chamber assembly facing the rear surface of the non-orbiting scroll. The valve guide may include bypass valve guide holes into which bypass valves that open and close the bypass holes are slidably inserted in an axial direction. Accordingly, the bypass valves for that suppress or prevent overcompression in the compression chambers are not fastened to a non-orbiting end plate, which may allow the non-orbiting end plate to be formed thin. As the non-orbiting end plate is reduced in thickness, lengths of the bypass holes may be reduced, thereby decreasing dead volumes in the bypass holes.

The back pressure chamber assembly may be provided with an intermediate discharge port that communicates with the inner space of the casing. A discharge guide passage may be defined between the valve guide and the valve accommodating groove, such that the discharge port and the bypass holes communicate with the intermediate discharge port. Through this, even if the valve guide is installed between the bypass holes and the intermediate discharge port, refrigerant discharged through the discharge port and/or the bypass holes may smoothly move to the intermediate discharge port.

A thickness of the valve guide may be smaller than a depth of the valve accommodating groove, so that a first discharge guide passage is defined between a first axial side surface of the valve guide and the valve accommodating groove. A cross-sectional area of the valve guide may be smaller than a cross-sectional area of the valve accommodating groove, so that a second discharge guide passage is defined between an outer circumferential surface of the valve guide and an inner circumferential surface of the valve accommodating groove. The first discharge guide passage and the second discharge guide passage may communicate with each other. Through this, a discharge guide passage may be defined by a lower surface and side surface of the valve guide. Therefore, even if the valve guide is inserted into the valve accommodating groove, refrigerant that is discharged through the discharge port and/or the bypass holes may smoothly move toward the intermediate discharge port.

A discharge valve guide hole may be formed in the valve guide so that a discharge valve that opens and closes the discharge port is slidably inserted. The bypass valve guide holes may be formed at both sides with the discharge valve guide hole interposed therebetween. Through this, the bypass valves as well as the discharge valve may be configured as piston valves, so as to be modularized with the valve guide, such that the bypass valves and the discharge valve may be easily assembled.

Guide insertion grooves may be recessed into the rear surface of the non-orbiting scroll by a preset or predetermined depth at an outside of the valve accommodating groove. The valve guide may be inserted into the guide insertion grooves to be fixed to the rear surface of the back pressure chamber assembly. Accordingly, the valve guide may be fixed to the back pressure chamber assembly and assembled between the back pressure chamber assembly and the non-orbiting end plate, such that the valve assembly including the valve guide may be easily assembled. At the same time, as the bypass valves and/or the discharge valve are configured as the piston valves, a thickness of the non-orbiting end plate may be reduced, and thus, dead volumes in the bypass holes and/or the discharge port may decrease.

The guide insertion grooves may extend outward from an inner circumferential surface of the valve accommodating groove. A depth of each of the guide insertion grooves may be shallower than or equal to a depth of the valve accommodating groove. Through this, the valve guide may be inserted into the valve accommodating groove, and simultaneously, a space defining a discharge guide passage may be secured between the valve guide and the valve accommodating groove facing the valve guide in the axial direction.

Guide separation protrusions may extend from a second axial side surface of the valve guide that faces the back pressure chamber assembly toward the rear surface of the back pressure chamber assembly in the axial direction. A height of each of the guide separation protrusions may be smaller than or equal to a distance between the valve accommodating groove and the first axial side surface of the valve guide facing the valve accommodating groove. Through this, a gap for a discharge guide passage may be secured between the valve guide and the back pressure chamber assembly, and simultaneously, a gap for the discharge guide passage may also be secured between the valve guide and the valve accommodating groove facing the valve guide in the axial direction.

The valve guide may include guide fastening holes that are fastened to the non-orbiting scroll. The guide fastening holes may be formed through the guide separation protrusions, respectively, in the axial direction. This may increase lengths of the guide fastening holes, such that fastening members may be stably supported even if the valve guide becomes thin in thickness.

A discharge guide groove that accommodates the bypass valves may be formed in the rear surface of the back pressure chamber assembly facing the valve guide. A depth of the discharge guide groove may be smaller than or equal to a distance between the valve accommodating groove and the first axial side surface of the valve guide facing the valve accommodating groove. This may suppress or prevent the bypass valves from being excessively open. Accordingly, the bypass valves may be stabilized in behavior during opening and also may be quickly closed to suppress or prevent refrigerant from flowing back into the bypass holes.

An intermediate discharge port may be formed in the back pressure chamber assembly, such that the discharge port and the bypass holes communicate with the inner space of the casing. The discharge guide groove may be formed in an annular shape and communicate with the intermediate discharge port. With this configuration, even if the valve guide is located between the discharge port and the bypass holes and the intermediate discharge port, a wide discharge guide passage may be secured between the discharge port and bypass holes and the intermediate discharge port, such that refrigerant may be smoothly discharged.

Guide separation protrusions may extend from a second axial side surface of the valve guide that faces the back pressure chamber assembly toward the rear surface of the back pressure chamber assembly in the axial direction. A discharge guide groove that accommodates the bypass valves may be formed in the rear surface of the back pressure chamber assembly facing the valve guide. A length of a sum of a height of the guide separation protrusion and the depth of the discharge guide groove may be smaller than or equal to the distance between the valve accommodating groove and the first axial side surface of the valve guide facing the valve accommodating groove. This may suppress the bypass valves from being excessively open. Accordingly, the bypass valves may be stabilized in behavior during opening and also may be quickly closed to suppress or prevent refrigerant from flowing back into the bypass holes.

The valve guide may include a guide main body and guide fixing protrusions. The guide main body may be inserted into the valve accommodating groove. The guide fixing protrusions may extend from the guide main body to be inserted into the guide insertion grooves, and may have guide fastening holes formed therethrough in the axial direction, respectively. The valve guide may be fixed to the rear surface of the back pressure chamber assembly by fastening members that are fastened to the rear surface of the back pressure chamber assembly through the guide fastening holes, respectively. This may allow the valve assembly including the valve guide to be simply and stably fixed to the back pressure chamber assembly, and a thickness of the non-orbiting end plate may be reduced so as to decrease dead volumes in the discharge port and/or the bypass holes.

The valve guide may include a guide main body and guide fixing protrusions. The guide main body may be inserted into the valve accommodating groove, and may extend from the guide main body to be inserted into the guide insertion groove. A guide support surface may axially extend from at least one of the guide insertion groove or the guide fixing protrusions facing the guide insertion groove. The valve guide may be fixed as the guide fixing protrusions are pressed onto the non-orbiting scroll and the back pressure chamber assembly by the guide support surface. This may allow the valve assembly including the valve guide to be stably fixed to the back pressure chamber assembly without separate fastening members, and simultaneously a thickness of the non-orbiting end plate may be reduced so as to decrease dead volumes in the discharge port and/or the bypass holes.

A guide accommodating groove may be recessed by a preset or predetermined depth into the rear surface of the back pressure chamber assembly. The valve guide may be accommodated in the guide accommodating groove to be fixed to the rear surface of the non-orbiting scroll at an outside of the valve accommodating groove. Accordingly, the valve guide may be fixedly inserted into the non-orbiting end plate, such that the valve assembly including the valve guide may be easily assembled. At the same time, as the bypass valves and/or the discharge valve are configured as the piston valves, a thickness of the non-orbiting end plate may be reduced, and thus, dead volumes in the bypass holes and/or the discharge port may decrease.

An intermediate discharge port may be formed in the back pressure chamber assembly, such the discharge port and the bypass holes communicate with the inner space of the casing. Discharge guide passages may be continuously defined between the valve guide and the valve accommodating groove and between the valve guide and the guide accommodating groove, to communicate with the intermediate discharge port. Accordingly, the valve guide may be fixedly inserted into the non-orbiting scroll and the back pressure chamber assembly, respectively, and simultaneously, a discharge guide passage may be secured between the valve guide and the non-orbiting scroll, so that refrigerant discharged from the bypass holes and/or the discharge port may rapidly move toward the intermediate discharge port.

A valve guide groove may be formed at an inner side of the intermediate discharge port to accommodate a discharge valve that opens and closes the discharge port. The guide accommodating groove and the valve guide groove may overlap each other in a radial direction. This may secure a discharge guide passage between the valve guide and the middle discharge port while the valve guide is inserted into the back pressure chamber assembly.

The valve guide may include a guide main body and guide fixing protrusions. The guide main body may be inserted into the valve accommodating groove, and the guide fixing protrusions may extend from the guide main body to an outside of the valve accommodating groove, and have guide fastening holes formed therethrough in the axial direction. The valve guide may be fixed to the rear surface of the non-orbiting scroll by fastening members that are fastened to the rear surface of the non-orbiting scroll through the guide fastening holes, respectively. This may allow the valve assembly including the valve guide to be simply and stably fixed to the non-orbiting scroll, and a thickness of the non-orbiting end plate may be reduced so as to decrease dead volumes in the discharge port and/or the bypass holes.

The valve guide may include a guide main body and guide fixing protrusions. The guide main body may be inserted into the valve accommodating groove, and the guide fixing protrusions may extend from the guide main body to the outside of the valve accommodating groove. A guide support surface may axially extend from at least one of the guide accommodating groove or the guide fixing protrusions facing the guide accommodating groove. The valve guide may be fixed as the guide fixing protrusions are pressed onto the non-orbiting scroll and the back pressure chamber assembly by the guide support surface. This may allow the valve assembly including the valve guide to be stably fixed to the non-orbiting scroll without separate fastening members, and simultaneously, a thickness of the non-orbiting end plate may be reduced so as to decrease dead volumes in the discharge port and/or the bypass holes.

A thickness of the valve guide inserted into the valve accommodating groove may be smaller than or equal to a distance between the valve accommodating groove and a first axial side surface of the valve guide facing the valve accommodating groove. This may secure a support length for the bypass valves to stably support the valves during opening of the bypass valves, and simultaneously, may shorten a closing time of the bypass valves to suppress a reverse flow of refrigerant to the bypass holes.

In addition, each of the bypass valves may include at least one guide portion and an opening/closing portion. The guide portion may be slidably inserted into the bypass valve guide hole, and the opening/closing portion may be disposed on one end of the guide portion to open and close the bypass hole. Through this, as the bypass valve is configured as a piston valve, a thickness of the non-orbiting end plate may be reduced, so as to decrease a dead volume in the bypass hole.

A stopper may extend laterally from another end of the guide portion. A cross-sectional area of the stopper may be larger than a cross-sectional area of the bypass valve guide hole, such that the stopper is axially supported on a second axial side surface of the valve guide. This may limit an open degree of the bypass valve, to stabilize the behavior of the bypass valve and improve a valve response.

A cross-sectional area of the opening/closing portion may be larger than a cross-sectional area of the bypass valve guide hole, such that the opening/closing portion is axially supported on the first axial side surface of the valve guide. This may limit an open degree of the bypass valve, to stabilize the behavior of the bypass valve and improve valve response.

A weight-reducing portion may be formed in the bypass valve. The weight-reducing portion may be recessed by a preset or predetermined depth from one (first) end toward another (second) end of the bypass valve. This may reduce a weight of the bypass valve, thereby increase a valve response.

The weight-reducing portion may be formed toward the opening/closing portion at an opposite side of the opening/closing portion. The guide portion may be provided with an oil drainage hole formed to penetrate from an inner circumferential surface of the weight-reducing portion to an outer circumferential surface of the guide portion. As the weight-reducing portion is formed in the bypass valve and the opening/closing portion is formed in a closed shape, the substantial dead volume in the bypass hole may decrease. At the same time, stagnation of oil in the weight-reducing portion may be suppressed, thereby enhancing a valve response.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

an orbiting scroll coupled to a rotary shaft in an inner space of the casing to perform an orbiting motion;

a non-orbiting scroll engaged with the orbiting scroll to define compression chambers, and provided with a discharge port and bypass holes through which refrigerant in the compression chambers is discharged; and a back pressure chamber assembly coupled to a rear surface of the non-orbiting scroll to press the non-orbiting scroll toward the orbiting scroll, wherein a valve accommodating groove is recessed by a predetermined depth into the rear surface of the non-orbiting scroll to accommodate the discharge port and the bypass holes, wherein a valve guide is disposed between the rear surface of the non-orbiting scroll and a rear surface of the back pressure chamber assembly facing the rear surface of the non-orbiting scroll, wherein the valve guide includes bypass valve guide holes into which bypass valves that open and close the bypass holes are slidably inserted in an axial direction, and wherein each of the bypass valves comprises:

at least one guide portion slidably inserted into the bypass valve guide holes; and an opening/closing portion disposed on a first end of the at least one guide portion to open and close the bypass hole.

2. The scroll compressor of claim 1, wherein the back pressure chamber assembly is provided with an intermediate discharge port that communicates with the inner space of the casing, and wherein at least one discharge guide passage is defined between the valve guide and the valve accommodating groove, such that the discharge port and the bypass holes communicate with the intermediate discharge port.

3. The scroll compressor of claim 2, wherein the at least one discharge guide passage comprises a first discharge guide passage and a second discharge guide passage, wherein a thickness of the valve guide is smaller than a depth of the valve accommodating groove, so that the first discharge guide passage is defined between a first axial side surface of the valve guide and the valve accommodating groove, wherein a cross-sectional area of the valve guide is smaller than a cross-sectional area of the valve accommodating groove, so that the second discharge guide passage is defined between an outer circumferential surface of the valve guide and an inner circumferential surface of the valve accommodating groove, and wherein the first discharge guide passage and the second discharge guide passage communicate with each other.

4. The scroll compressor of claim 2, wherein a discharge valve guide hole is formed in the valve guide into which a discharge valve that opens and closes the discharge port is slidably inserted, and wherein the bypass valve guide holes are formed at lateral sides of the discharge valve guide hole with the discharge valve guide hole interposed therebetween.

5. The scroll compressor of claim 1, wherein guide insertion grooves are recessed into the rear surface of the non-orbiting scroll by a predetermined depth at an outside of the valve accommodating groove, and wherein the valve guide is inserted into the guide insertion grooves to be fixed to the rear surface of the back pressure chamber assembly.

6. The scroll compressor of claim 5, wherein the guide insertion grooves extend outward from an inner circumferential surface of the valve accommodating groove, and wherein a depth of each of the guide insertion grooves is shallower than or equal to a depth of the valve accommodating groove.

7. The scroll compressor of claim 5, wherein guide separation protrusions extend from a first axial side surface of the valve guide that faces the back pressure chamber assembly toward the rear surface of the back pressure chamber assembly in the axial direction, and wherein a height of each of the guide separation protrusions is smaller than or equal to a distance between the valve accommodating groove and a second axial side surface of the valve guide facing the valve accommodating groove.

8. The scroll compressor of claim 7, wherein the valve guide is provided with guide fastening holes fastened to the non-orbiting scroll, and wherein the guide fastening holes are formed through the guide separation protrusions, respectively, in the axial direction.

9. The scroll compressor of claim 5, wherein a discharge guide groove that accommodates the bypass valves is formed in the rear surface of the back pressure chamber assembly facing the valve guide, and wherein a depth of the discharge guide groove is smaller than or equal to a distance between the valve accommodating groove and a first axial side surface of the valve guide facing the valve accommodating groove.

10. The scroll compressor of claim 9, wherein an intermediate discharge port is formed in the back pressure chamber assembly, such that the discharge port and the bypass holes communicate with the inner space of the casing, and wherein the discharge guide groove is formed in an annular shape and communicates with the intermediate discharge port.

11. The scroll compressor of claim 9, wherein guide separation protrusions extend from a second axial side surface of the valve guide that faces the back pressure chamber assembly toward the rear surface of the back pressure chamber assembly in the axial direction, wherein the discharge guide groove that accommodates the bypass valves is formed in the rear surface of the back pressure chamber assembly facing the valve guide, and wherein a length of a sum of a height of the guide separation protrusions and a depth of the discharge guide groove is smaller than or equal to a distance between the valve accommodating groove and the first axial side surface of the valve guide facing the valve accommodating groove.

12. The scroll compressor of claim 5, wherein the valve guide comprises:

a guide main body inserted into the valve accommodating groove; and guide fixing protrusions that extend from the guide main body to be inserted into the guide insertion grooves, and having guide fastening holes formed therethrough in the axial direction, respectively, and wherein the valve guide is fixed to the rear surface of the back pressure chamber assembly by fastening members that are fastened to the rear surface of the back pressure chamber assembly through the guide fastening holes, respectively.

13. The scroll compressor of claim 5, wherein the valve guide comprises:

a guide main body inserted into the valve accommodating groove; and guide fixing protrusions that extend from the guide main body to be inserted into the guide insertion grooves, respectively, and wherein guide support surfaces axially extend from at least one of the guide insertion grooves or the guide fixing protrusions facing the guide insertion grooves, and wherein the valve guide is fixed as the guide fixing protrusions are pressed onto the non-orbiting scroll and the back pressure chamber assembly by the guide support surfaces.

14. The scroll compressor of claim 1, wherein a guide accommodating groove is recessed by a predetermined depth into the rear surface of the back pressure chamber assembly, and wherein the valve guide is accommodated in the guide accommodating groove to be fixed to the rear surface of the non-orbiting scroll at an outside of the valve accommodating groove.

15. The scroll compressor of claim 14, wherein an intermediate discharge port is formed in the back pressure chamber assembly, such that the discharge port and the bypass holes communicate with the inner space of the casing, and wherein discharge guide passages are continuously defined between the valve guide and the valve accommodating groove and between the valve guide and the guide accommodating groove, to communicate with the intermediate discharge port.

16. The scroll compressor of claim 15, wherein a valve guide groove is formed at an inner side of the intermediate discharge port to accommodate a discharge valve that opens and closes the discharge port, and wherein the guide accommodating groove and the valve guide groove overlap each other in a radial direction.

17. The scroll compressor of claim 14, wherein the valve guide comprises:

a guide main body inserted into the valve accommodating groove; and guide fixing protrusions that extend from the guide main body to an outside of the valve accommodating groove, and having guide fastening holes formed therethrough in the axial direction, and wherein the valve guide is fixed to the rear surface of the non-orbiting scroll by fastening members that are fastened to the rear surface of the rear surface of the non-orbiting scroll through the guide fastening holes, respectively.

18. The scroll compressor of claim 14, wherein the valve guide comprises:

a guide main body inserted into the valve accommodating groove; and guide fixing protrusions that extend from the guide main body to an outside of the valve accommodating groove, wherein guide support surfaces axially extend from at least one of the guide accommodating groove or the guide fixing protrusions facing the guide accommodating groove, and wherein the valve guide is fixed as the guide fixing protrusions are pressed onto the non-orbiting scroll and the back pressure chamber assembly by the guide support surface.

19. The scroll compressor of claim 14, wherein a thickness of the valve guide inserted into the valve accommodating groove is smaller than or equal to a distance between the valve accommodating groove and a first axial side surface of the valve guide facing the valve accommodating groove.

20. The scroll compressor of claim 1, wherein a stopper extends laterally from a second end of the at least one guide portion, and wherein a cross-sectional area of the stopper is larger than a cross-sectional area of the bypass valve guide hole, such that the stopper is axially supported on an axial side surface of the valve guide.

21. The scroll compressor of claim 1, wherein a cross-sectional area of the opening/closing portion is larger than a cross-sectional area of the bypass valve guide hole, such that the opening/closing portion is axially supported on the axial side surface of the valve guide.

22. The scroll compressor of claim 1, wherein a weight-reducing portion is formed inside of each of the bypass valves, and wherein the weight-reducing portion is recessed by a predetermined depth from a first end toward a second end of the bypass valve.

23. The scroll compressor of claim 22, wherein the weight-reducing portion is formed toward the opening/ closing portion at an opposite side of the opening/closing portion, and wherein the at least one guide portion is provided with an oil drainage hole formed to penetrate from an inner circumferential surface of the weight-reducing portion to an outer circumferential surface of the at least one guide portion.

24. A scroll compressor, comprising:

a casing;

an orbiting scroll coupled to a rotary shaft in an inner space of the casing to perform an orbiting motion;

a non-orbiting scroll engaged with the orbiting scroll to define compression chambers, and provided with a discharge port and bypass holes through which refrigerant in the compression chambers is discharged; and a back pressure chamber assembly including a back pressure chamber and a floating plate, the back pressure chamber assembly being coupled to a rear surface of the non-orbiting scroll to press the non-orbiting scroll toward the orbiting scroll, wherein a valve accommodating groove is recessed by a predetermined depth into the rear surface of the non-orbiting scroll to accommodate the discharge port and the bypass holes, wherein a valve guide is disposed between the rear surface of the non-orbiting scroll and a rear surface of the back pressure chamber assembly facing the rear surface of the non-orbiting scroll, wherein the valve guide includes bypass valve guide holes into which bypass valves that open and close the bypass holes are slidably inserted in an axial direction, wherein the back pressure chamber assembly further comprises an intermediate discharge port that communicates with the inner space of the casing, and wherein at least one discharge guide passage is defined between the valve guide and the valve accommodating groove, such that the discharge port and the bypass holes communicate with the intermediate discharge port.

25. A scroll compressor, comprising:

a casing;

an orbiting scroll coupled to a rotary shaft in an inner space of the casing to perform an orbiting motion;

a non-orbiting scroll engaged with the orbiting scroll to define compression chambers, and provided with a discharge port and bypass holes through which refrigerant in the compression chambers is discharged; and a back pressure chamber assembly including a back pressure chamber and a floating plate, the back pressure chamber assembly being coupled to a rear surface of the non-orbiting scroll to press the non-orbiting scroll toward the orbiting scroll, wherein a valve accommodating groove is recessed by a predetermined depth into the rear surface of the non-orbiting scroll to accommodate the discharge port and the bypass holes, wherein a valve guide is disposed between the rear surface of the non-orbiting scroll and a rear surface of the back pressure chamber assembly facing the rear surface of the non-orbiting scroll, wherein the valve guide includes bypass valve guide holes into which bypass valves that open and close the bypass holes are slidably inserted in an axial direction, wherein guide insertion grooves are recessed into the rear surface of the non-orbiting scroll by a predetermined depth at an outside of the valve accommodating groove, and wherein the valve guide is inserted into the guide insertion grooves to be fixed to the rear surface of the back pressure chamber assembly.

* * * * *